US006718941B2

(12) United States Patent
Asano et al.

(10) Patent No.: US 6,718,941 B2
(45) Date of Patent: Apr. 13, 2004

(54) ENGINE FUEL CONTROL DEVICE AND CONTROL METHOD FOR REQUESTED IDLE AIR QUANTITY

(75) Inventors: Seiji Asano, Hitachinaka (JP); Bunji Igarashi, Mito (JP); Satoshi Yamaji, Hitachinaka (JP)

(73) Assignees: Hitachi, Ltd., Tokyo (JP); Hitachi Car Engineering Co., Ltd., Ibaraki (JP)

( * ) Notice: Subject to any disclaimer, the term of this patent is extended or adjusted under 35 U.S.C. 154(b) by 0 days.

(21) Appl. No.: 10/328,050

(22) Filed: Dec. 26, 2002

(65) Prior Publication Data

US 2003/0116126 A1 Jun. 26, 2003

(30) Foreign Application Priority Data

Dec. 26, 2001 (JP) ..... 2001-393337

(51) Int. Cl.[7] ..... F02M 3/00

(52) U.S. Cl. ..... 123/339.23; 123/339.22; 123/336

(58) Field of Search ..... 123/339.23, 339.22, 123/336, 339.1

(56) References Cited

U.S. PATENT DOCUMENTS 4,378,761 A * 4/1983 Kawamura ..... 123/184.21
4,417,533 A * 11/1983 Oshima et al. ..... 112/235
4,478,183 A * 10/1984 Misch et al. ..... 123/339.21
6,334,430 B1 * 1/2002 Itabashi ..... 123/336

* cited by examiner

*Primary Examiner*—Bibhu Mohanty
(74) *Attorney, Agent, or Firm*—Crowell & Moring LLP

(57) ABSTRACT

An engine fuel control device includes an idle speed control valve that is disposed in a bypass passage that bypasses a throttle valve, a starting phase determination means that determines whether the engine is in a pre-start phase or a post-start phase, a first opening setting means that sets the opening of the idle speed control valve before starting, a second opening setting means that sets the opening of the idle speed control valve after starting, and a target opening setting means that sets at least one target opening for the idle speed control valve opening when the engine shifts from the pre-start phase to the post-start phase. While the engine is being started, the fuel control device shifts the ISC valve opening from the opening before the complete explosion is determined to the target opening after the complete explosion and eventually to the opening after the complete explosion.

10 Claims, 22 Drawing Sheets

ENGINE FUEL CONTROL DEVICE AND CONTROL METHOD FOR REQUESTED IDLE AIR QUANTITY

BACKGROUND OF THE INVENTION

The present invention relates to an engine fuel control device and a control method for requested idle air quantity and, more particularly, to an improvement made on a control method for an amount of air requested for idling when the engine is started performed by a fuel control system that supplies the engine with gaseous fuel.

A gaseous fuel vehicle mounted with an engine operating on CNG (compressed natural gas), a type of gaseous fuel, is known. The gaseous fuel in a gaseous fuel container is taken through a fuel supply pipe. A pressure reducing valve then regulates a pressure and a flow rate of the gaseous fuel to corresponding predetermined levels. A gas mixer finally mixes the gaseous fuel with air and the fuel is supplied through a fixed venturi to the engine.

Japanese Patent Laid-open No. 2000-18100 discloses a fuel supply system for a gaseous fuel engine. A gaseous fuel supply system disclosed in this publication has the following arrangement. Namely, a three-port solenoid valve is provided at a place near a fixed venturi of a gas mixer located in a point midway a fuel supply pipe. There is also provided a bypass passage that connects the three-port solenoid valve to an air intake system located downstream from a throttle valve of the engine. A control means is provided for controlling the position of the three-port solenoid valve, thereby directing the gaseous fuel toward a side of the bypass passage. In addition, there is provided a branch pipe that branches from the fuel supply pipe downstream from a pressure reducing valve. The branch pipe is connected to an auxiliary injector disposed in the air intake system downstream from the engine throttle valve. There is provided the three-port solenoid valve at the place near the fixed venturi of the gas mixer located in a point midway the fuel supply pipe. There is also provided the bypass passage that connects the three-port solenoid valve to the air intake system located downstream from the engine throttle valve. A control means is then provided for controlling the position of the three-port solenoid valve so as to direct gaseous fuel toward the bypass passage side only during starting of the engine, while, during acceleration, actuating the auxiliary injector so as to correct the amount of gaseous fuel supplied.

This arrangement ensures a smooth operation of the three-port solenoid valve, providing communication at one time with the fixed venturi side of the gas mixer and at another time with the bypass passage side, thereby allowing the gaseous fuel to flow smoothly. While ensuring a smooth flow of gaseous fuel, the arrangement directs the gaseous fuel toward the bypass passage side during, for example, starting the engine. This eliminates a situation, in which the gaseous fuel is hard to discharge because of a slow flow rate at the fixed venture, thus improving startability.

No considerations are, however, given to an amount of air requested for idling and a venturi chamber pressure during starting of the engine in the conventional fuel supply system for gaseous fuel engines, such as this one. The amount of air requested for idling, or a requested idle air quantity, while the engine is being started is generally set to a level relatively higher than the requested idle air quantity after the engine has been started. Furthermore, since there is no venturi chamber pressure developing during starting, a fuel supply valve is set so that an air-fuel ratio at starting can be obtained with a small pressure difference. As a result, with the engine speed increasing after starting, there would be a sudden drop in the venturi chamber pressure. This causes a mixture gas to become excessively rich and a resultant aggravated combustion leads to poor startability and a decreased engine speed after starting.

SUMMARY OF THE INVENTION

The present invention has been made in view of the above-mentioned problems, and an object of the present invention is therefore to provide an engine fuel control device and a control method for requested idle air quantity that allow a stabilized air-fuel ratio to be maintained during starting with no regard to an engine coolant temperature during starting and a stabilized engine speed to be obtained after starting.

To achieve the foregoing object, an engine fuel control device according to the present invention is basically provided with a fuel supply means that supplies an engine with a fuel, a mixture ratio determination means that determines a mixing ratio of a mixture of the fuel and air, a mixture introduction means that introduces the air-fuel mixture, whose mixing ratio has been determined, a flow rate determination means that determines a flow rate of the mixture of the fuel and air to be drawn in by the engine, a first throttle valve that is disposed in an intake pipe of the engine, a bypass passage that bypasses the first throttle valve, and a second throttle valve that is disposed in the bypass passage. This engine fuel control device is characterized in that it is further provided with a starting phase determination means that determines whether the engine is in a pre-start phase or a post-start phase, a first opening setting means that sets the opening of the second throttle valve before starting, a second opening setting means that sets the opening of the second throttle valve after starting, and a target opening setting means that sets at least one target opening for the second throttle valve opening when the engine shifts from the pre-start phase to the post-start phase.

A control method for requested idle air quantity according to the present invention is used in the engine fuel control device including the first throttle valve disposed in the intake pipe of the engine, the bypass passage bypassing the first throttle valve, the second throttle valve disposed in the bypass passage, wherein the second throttle valve opening is controlled so as to maintain a target engine speed as set as the target engine speed during idling. The control method comprises the steps of determining the pre-start phase and the post-start phase of the engine, setting the second throttle valve opening for the pre-start phase, setting at least one target opening for the second throttle valve opening when the engine shifts from the pre-start phase to the post-start phase, and setting the second throttle valve opening for the post-start phase.

According to the engine fuel control device and the control method for requested idle air quantity configured as described in the foregoing paragraphs, the opening in the pre-start phase of the engine and that in the post-start phase of the engine are set for the second throttle valve mounted in the bypass passage that bypasses the first throttle valve. This makes it possible to provide a fuel gas that achieves an air-fuel ratio for starting. In the meantime, it is also possible to achieve an air-fuel ratio that permits an idle speed control after the engine has been started by changing the opening of the second throttle valve after the engine has been started.

If the second throttle valve opening is temporarily shifted to a separately set target opening when the engine shifts from the pre-start phase to the post-start phase, it is possible to prevent the venturi chamber pressure from being dropped suddenly as caused by an increase in the speed during starting. This prevents the air-fuel ratio after the engine has been started from becoming excessively rich and a poor startability as caused by an aggravated combustion and a decreased engine speed after the engine has been started can be avoided.

In a preferred embodiment of the engine control device according to the present invention, the mixture ratio determination means is provided with a means that supplies the fuel supply means with fuel and a means that supplies the fuel supply means with air. It is characterized in that it determines a supply ratio of these two supply means.

In the preferred embodiment of the engine control device according to the present invention, the mixture ratio determination means sets the supply ratio in the pre-start phase of the engine and that in the post-start phase of the engine.

In the preferred embodiment of the engine control device according to the present invention, the supply ratio in the pre-start phase of the engine is determined based on factors that include one determined by an engine coolant temperature and one determined by an engine speed increase and the coolant temperature during starting.

In the preferred embodiment of the engine control device according to the present invention, the mixture ratio determination means selects the supply ratio according to the condition of loads of engine auxiliaries (for example, an air conditioner and other onboard electronic devices).

In the preferred embodiment of the engine control device according to the present invention, the mixture ratio determination means selects the supply ratio according to whether the engine is in an idle state or a non-idle state.

In the preferred embodiment of the engine control device according to the present invention, the starting phase determination means determines that the engine is being started based on a fact that the engine speed exceeds a predetermined value.

In the preferred embodiment of the engine control device according to the present invention, the starting phase determination means uses as a criterion value for determining that the engine is being started the coolant temperature when the engine is being started.

In the preferred embodiment of the engine control device according to the present invention, the starting phase determination means selects the criterion value for determining that the engine is being started according to the condition of loads of engine auxiliaries.

BRIEF DESCRIPTION OF THE DRAWINGS

Other objects and advantages of the invention will become apparent from the following description of embodiments with reference to the accompanying drawings in which.

DESCRIPTION OF THE PREFERRED EMBODIMENTS

A preferred embodiment of the engine fuel control device and the control method for requested idle air quantity according to the present invention will be described in detail with reference to the accompanying drawings.

Figure 1:
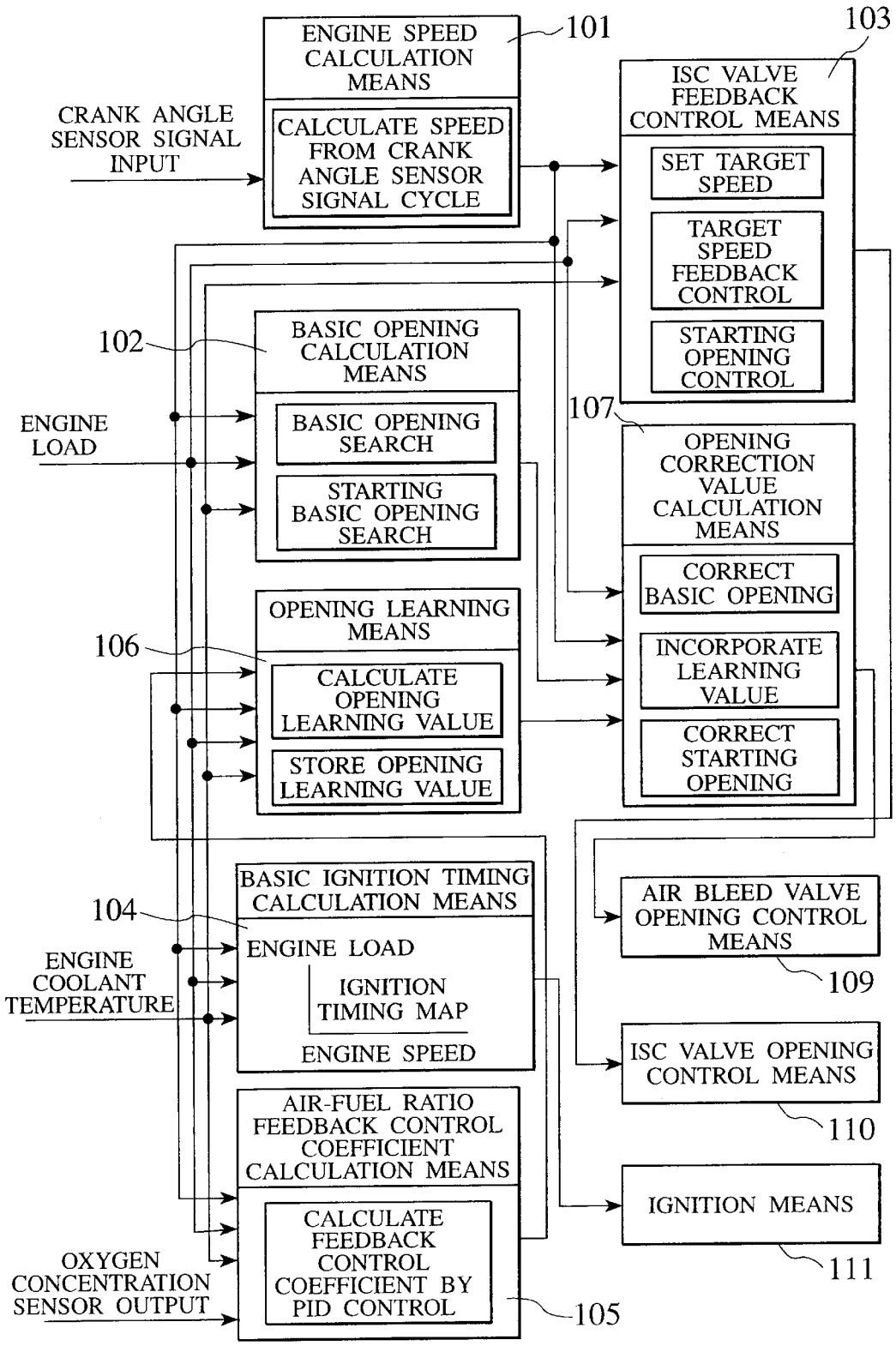
FIG. 1 is a control block diagram for a fuel control device provided with an ISC valve control method at the time of starting of a venturi type fuel supply device according to the preferred embodiment of the present invention.

FIG. 1 is a control block diagram for a fuel control device provided with an ISC valve control method at the time of starting of a venturi type fuel supply device.

Referring to FIG. 1, a block 101 represents one for an engine speed calculation means. The engine speed calculation means calculates an engine speed per unit time by counting an electrical signal of a crank angle sensor set to a predetermined crank angle position of the engine, mainly the number of inputs per unit time of a pulse signal change, and performing an arithmetic operation. A block 102 calculates an air bleed valve basic opening that results in an optimum air-fuel ratio in each of different operating ranges based on the engine speed calculated in the block 101 and an intake pipe pressure detected by a sensor mounted in an engine air intake pipe used as an engine load.

A block 103 sets a target engine speed during idling from the engine speed calculated in the block 101, the engine load, and an engine coolant temperature and determines an ISC valve opening through a feedback control so as to reach the set target engine speed. It is also provided with a starting ISC valve control method to ensure a good engine startability. A block 104 determines an optimum ignition timing in each of different operating ranges through a map search or the like based on engine loads from the engine speed and the engine load.

A block 105 calculates an air-fuel ratio feedback control coefficient from the engine speed, the engine load, the engine coolant temperature, and an output from an oxygen concentration sensor mounted in an engine exhaust pipe so that a mixture of fuel and air supplied to the engine may be maintained at a target air-fuel ratio to be described later. According to the preferred embodiment, the oxygen concentration sensor produces an output of a signal proportional to an exhaust air-fuel ratio. It is nonetheless possible that the sensor produces an output of a signal indicating that an exhaust gas is on either a rich side or a lean side with respect to a stoichiometric air-fuel ratio.

A block 106 calculates an opening learning value that represents the air bleed valve opening equivalent to the amount of deviation from the target air-fuel ratio based on the air-fuel ratio feedback control coefficient calculated in the block 105. It further stores the calculated value as a learning value.

A block 107 is provided with an opening correction control during starting so as to incorporate the opening learning value of the block 106 in the air bleed valve basic opening calculated in the block 102 and realize a good engine startability. A block 109 controls an actual air bleed valve opening according to the air bleed valve opening corrected in the block 107.

A block 110 controls an actual ISC valve opening using the ISC valve opening, for which the feedback control is provided in the block 103. A block 110 represents an ignition means that ignites a fuel mixture that has flowed into a cylinder according to the ignition timing established in the block 104. Though the engine load is represented by the intake pipe pressure according to the preferred embodiment, it may still be represented by the amount of air taken in by the engine.

Figure 2:
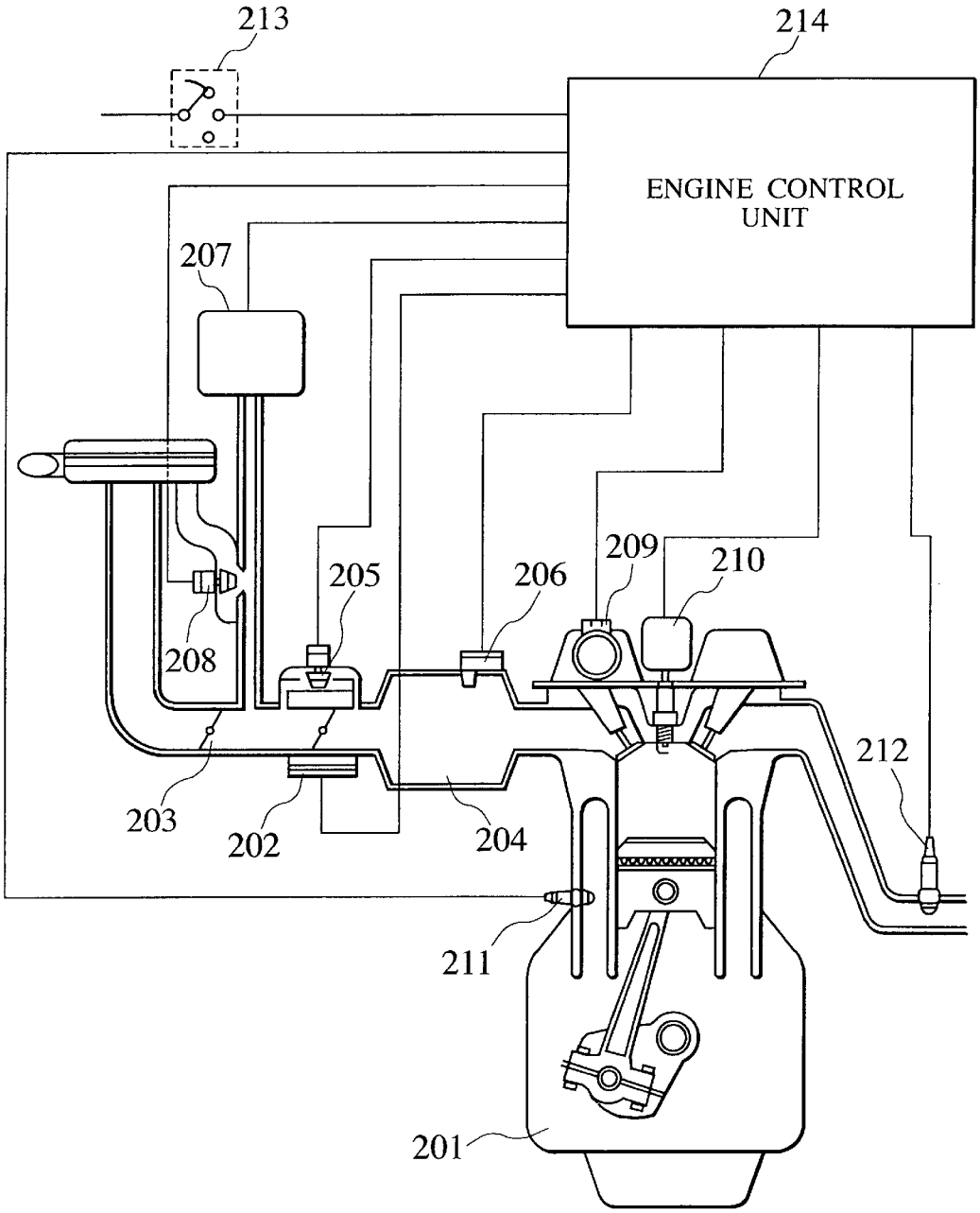
FIG. 2 shows a configuration of parts surrounding an engine controlled by the fuel control device provided with the ISC valve control method at the time of starting of the venturi type fuel supply device according to the preferred embodiment.

FIG. 2 shows a configuration of parts surrounding an engine controlled by the fuel control device provided with the ISC valve control method at the time of starting of the venturi type fuel supply device.

Referring to FIG. 2, an engine 201 is provided with the following components. Namely, main components include: a throttle valve 202 (a first throttle valve) that limits the amount of air taken in; a choke valve 203 that is disposed upstream from the throttle valve 202 and whose opening is adjusted together with that of the throttle valve 202 through a mechanical linkage mechanism; an idle speed control valve 205 (a second throttle valve) that controls a flow path area of a flow path connected to an intake pipe 204 by bypassing the throttle valve 202, thereby controlling the engine speed during idling; an intake pipe pressure sensor 206 that detects the pressure in the intake pipe 204; a regulator 207 that regulates the pressure of a fuel gas supplied to the engine; and an air bleed valve 208 (a mixture ratio determination means) that is disposed downstream from the regulator 207 and controls the flow path area of a passage open to atmosphere. Other components include: a crank angle sensor 209 that is set to a predetermined crank angle position of the engine; an ignition module 210 that supplies a spark plug that ignites the fuel mixture supplied to the engine cylinder with an ignition energy according to an ignition signal provided by an engine control unit 214; a coolant temperature sensor 211 that is mounted on an engine cylinder block and detects an engine coolant temperature; an oxygen concentration sensor 212 that is mounted on an engine exhaust pipe and detects oxygen concentration of an exhaust gas; an ignition key switch 213 that serves as a main switch for starting and stopping the engine; and the engine control unit 214 that controls the air-fuel ratio and ignition for the engine.

According to the preferred embodiment, the oxygen concentration sensor 212 produces an output of a signal proportional to the exhaust air-fuel ratio. It is nonetheless possible that the sensor 212 produces an output of a signal indicating that the exhaust gas is on either a rich side or a lean side with respect to the stoichiometric air-fuel ratio. In addition, though a fuel control is provided by detecting the intake pipe pressure according to the preferred embodiment, the air-fuel ratio control can still be provided by detecting the amount of air taken in by the engine.

Figure 3:
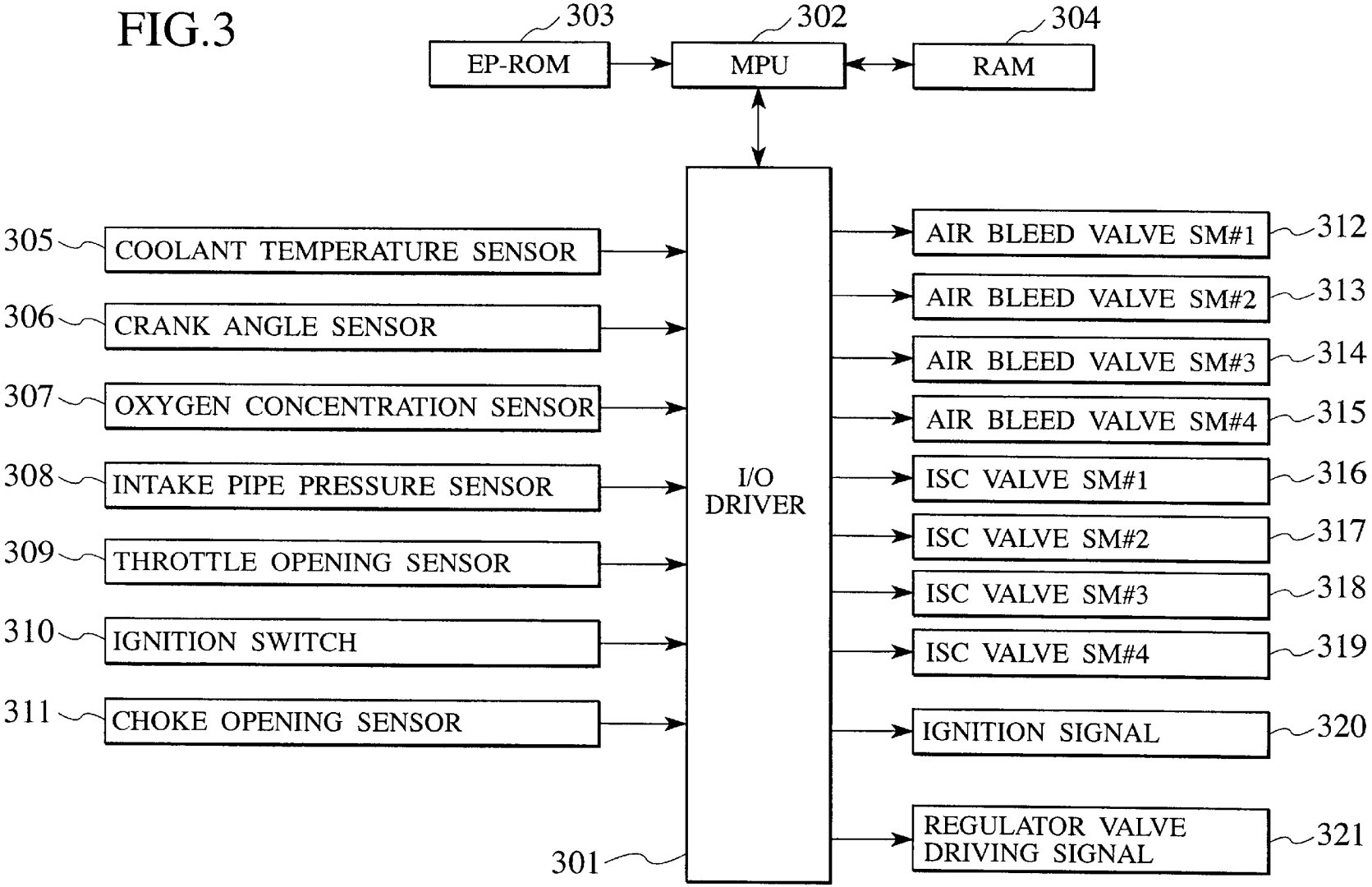
FIG. 3 shows an internal configuration of the fuel control device provided with the ISC valve control method at the time of starting of the venturi type fuel supply device according to the preferred embodiment.

FIG. 3 shows the internal configuration of the fuel control device provided with the ISC valve control method at the time of starting of the venturi type fuel supply device.

Referring to FIG. 3, the fuel control device is provided with the following components. Namely, an I/O LSI 301 that converts an electrical signal provided by each sensor mounted on the engine to a corresponding signal for digital operations and translates the digital operation control signal to a corresponding actual actuator driving signal; an arithmetic logic unit (MPU) 302 that determines an engine operating condition from the digital operation signal from the I/O LSI 301, calculates the amount of fuel required by the engine, ignition timing, and the like according to a predetermined procedure, and sends the calculated value to the I/O LSI 301; a nonvolatile memory (EPROM) 303 that stores therein control procedures and control constants for the arithmetic logic unit 302; and a volatile memory 304 that stores therein results of calculation performed by the arithmetic logic unit 302. A backup battery may be connected to the volatile memory (RAM) 304 so as to retain contents of memory even when power is not supplied the fuel control device with the ignition key switch turned OFF.

FIG. 3 shows a typical application of the fuel control device according to the preferred embodiment of the present invention. In the application, inputs are provided by a coolant temperature sensor 305, a crank angle sensor 306, an oxygen concentration sensor 307, an intake pipe pressure sensor 308, a throttle opening sensor 309, an ignition switch 310, and a choke opening sensor 311. Meanwhile, outputs are provided as air bleed valve opening command values 312 to 315, idle speed control valve opening command values 316 to 319, an ignition signal 320, and a regulator valve driving signal 321.

Figure 4:
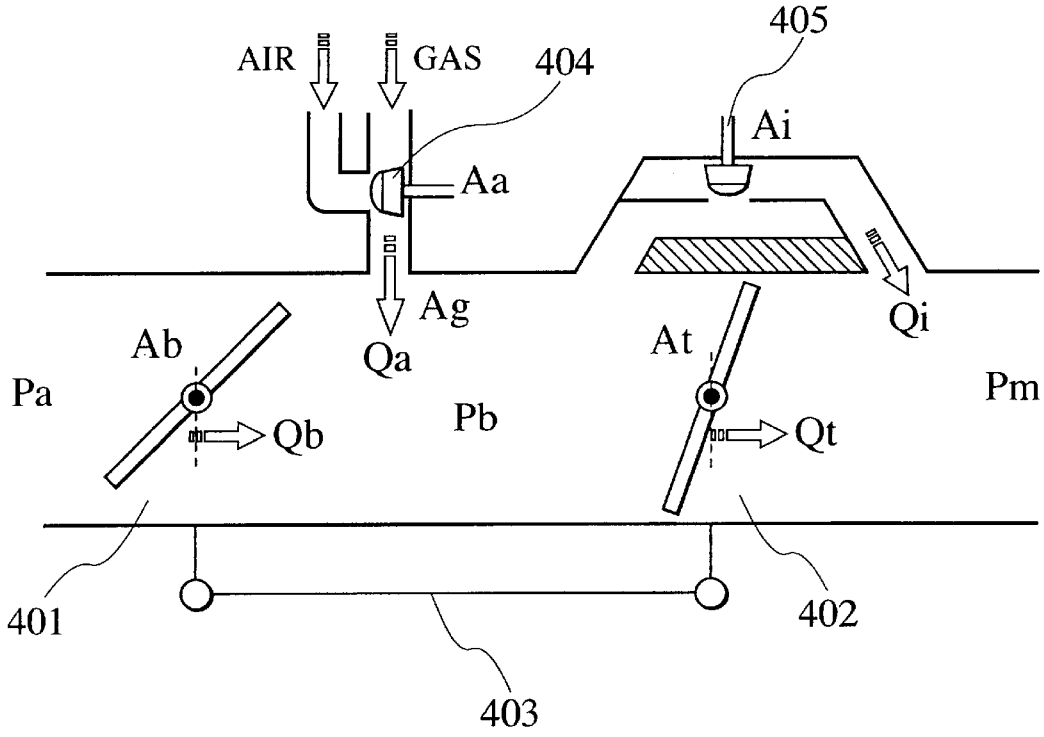
FIG. 4 shows a construction of an area around a venturi chamber between a choke valve and a throttle valve of the venturi type fuel supply device according to the preferred embodiment.

FIG. 4 shows the construction of an area around a venturi chamber between a choke valve and a throttle valve of the venturi type fuel supply device.

Referring to FIG. 4, a choke valve 401 and a throttle valve 402 are operatively connected to each other through a mechanical linkage 403. The mechanical linkage 403 is set so as to generate in the venturi chamber a negative pressure that allows a mixture gas to be taken in during idling. A passage is provided in the venturi chamber. The passage is provided therein with an air bleed valve 404 that determines the mixture ratio of the fuel gas and air of the fuel mixture gas. Another passage is provided so as to bypass the throttle valve 402. An ISC valve 405 controls the flow path area of this passage.

Figure 5:
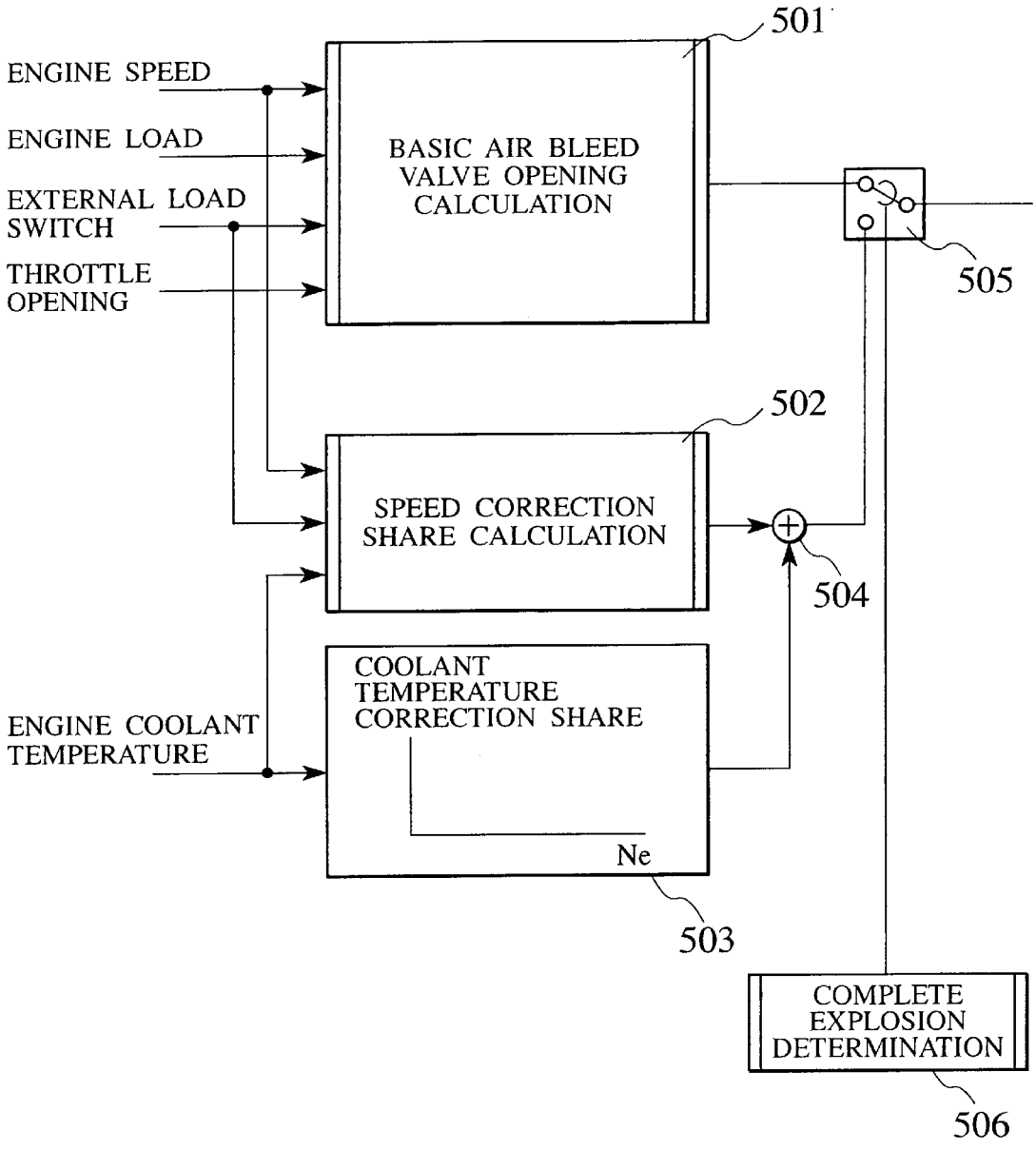
FIG. 5 shows an air bleed valve opening calculation block of the engine fuel control device according to the preferred embodiment.

FIG. 5 shows a calculation block for the air bleed valve opening.

Referring to FIG. 5, a block 501 calculates a basic air bleed valve opening based on the detected engine speed and engine load, an external load switch, a throttle opening, and the like. A block 502 calculates a speed correction share of the air bleed valve opening based on the engine speed, the external load switch, and the engine coolant temperature. A block 503 calculates a coolant temperature correction share of the air bleed valve opening based on the engine coolant temperature. An adder 504 is used to add up the speed correction share and the coolant temperature correction share, thereby giving the air bleed valve opening before a complete explosion. A switch 505 selects either the basic air bleed valve opening or the air bleed valve opening before the complete explosion according to a complete explosion decision made by a block 506 and a resultant output is provided as the air bleed valve opening.

Figure 6:
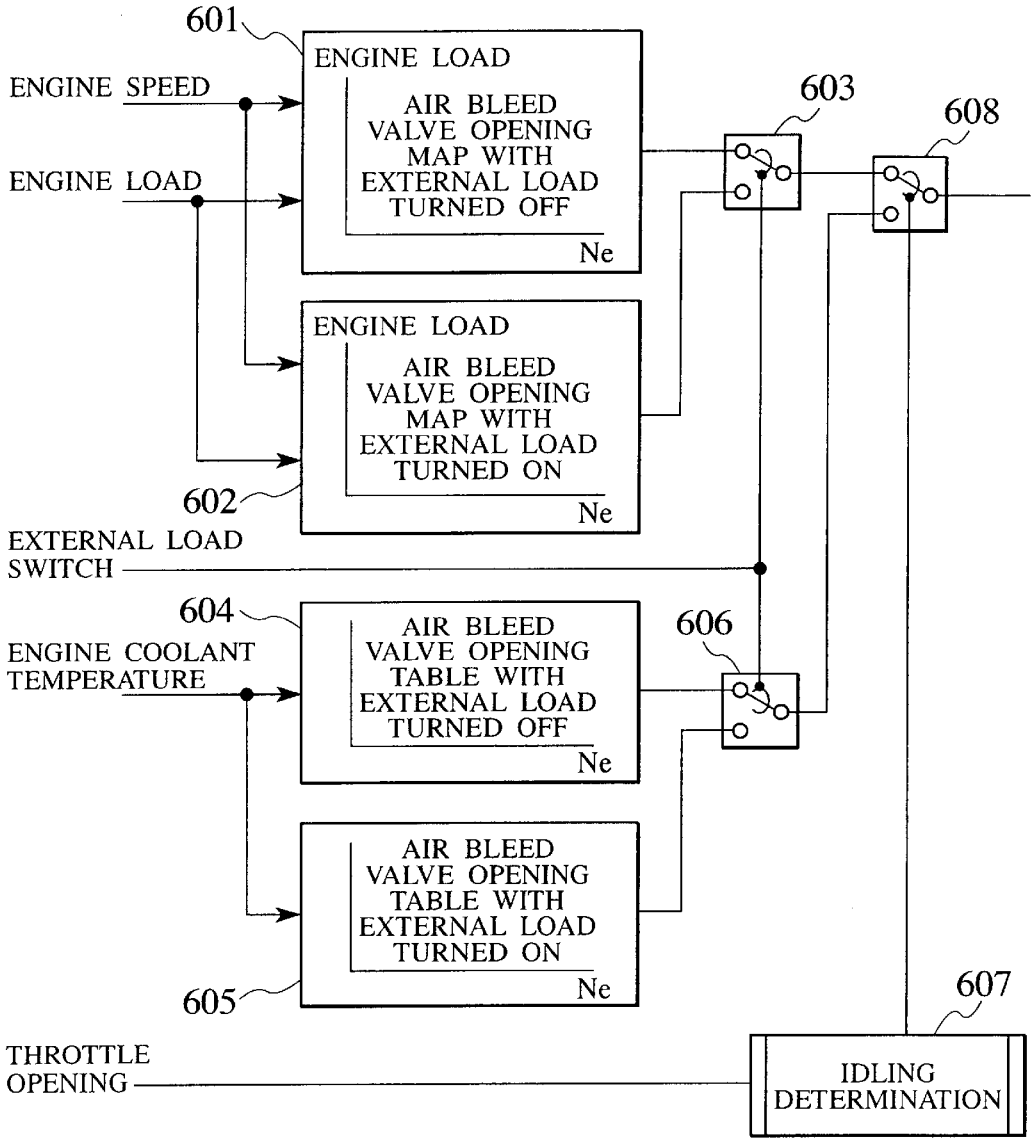
FIG. 6 shows a detailed configuration of the basic air bleed valve opening calculation block of the engine fuel control device according to the preferred embodiment.

FIG. 6 shows a detailed configuration of the basic air bleed valve opening calculation block shown in FIG. 5.

Referring to FIG. 6, a block 601 searches through an air bleed valve opening map set for the condition, in which the external load is turned OFF, with the engine speed and the engine load used as keys. A block 602 searches through, as in the block 601, an air bleed valve opening map set for the condition, in which the external load is turned ON, with the engine speed and the engine load used as keys. The air bleed valve opening of the blocks 601 and 602 are concerned with a case, in which the engine is in the non-idle state. Blocks 604 and 605 are, on the other hand, concerned with a case, in which the engine is in the idle state. The block 604 searches through an opening map set for the condition, in which the external load is turned OFF, with the engine coolant temperature used as the key. While the block 605 searches through an opening map set for the condition, in which the external load is turned ON, with the engine coolant temperature used as the key. Switches 603, 606 select the air bleed valve opening according to whether the external load switch is ON or OFF for each of the conditions in which the engine is in the non-idle state and in the idle state. An output of a final basic air bleed valve opening is produced through a switch 608 that selects the appropriate opening according to an idling decision made based on the throttle opening by a block 607.

Figure 7:
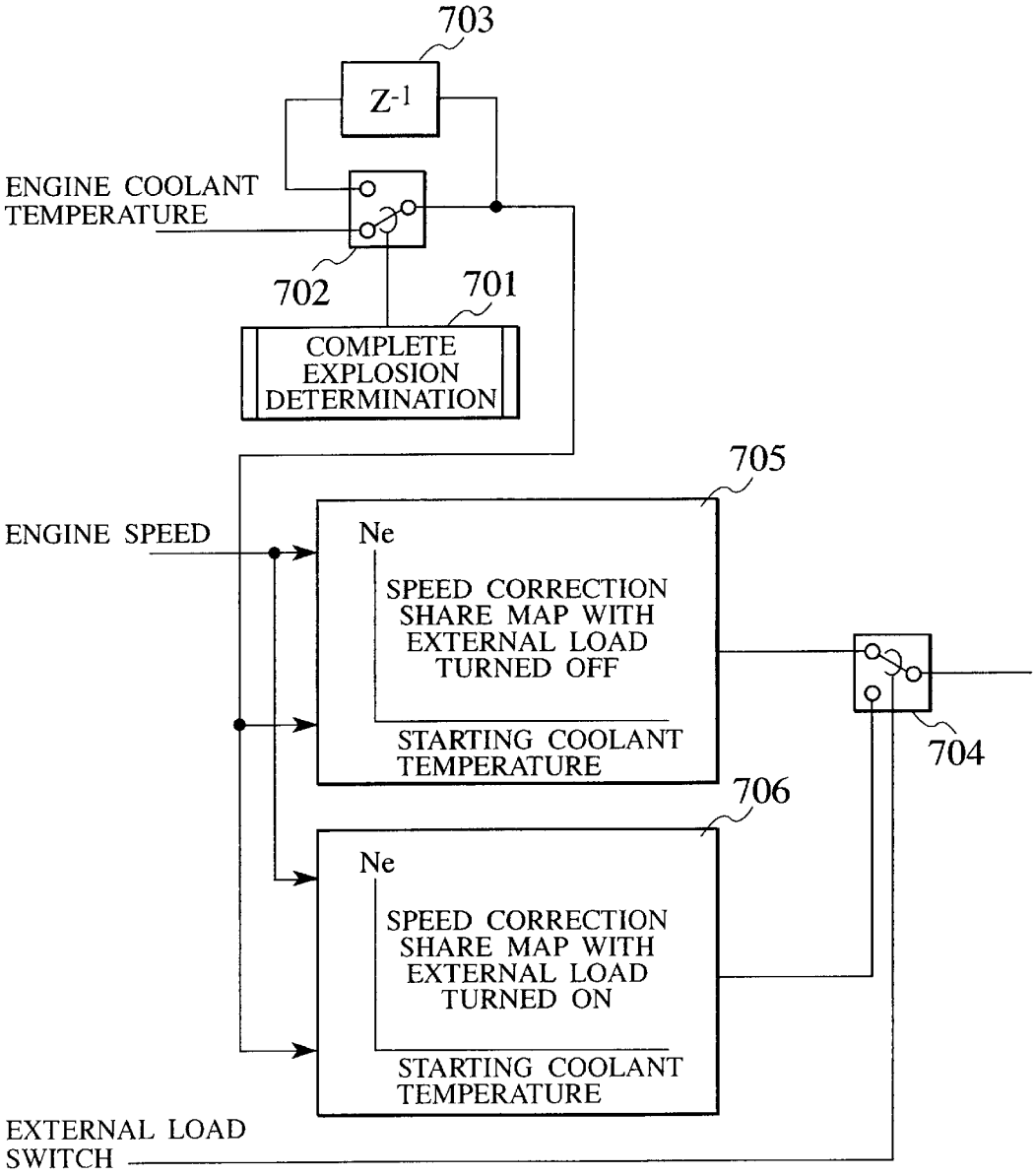
FIG. 7 shows a detailed configuration of a speed correction share calculation block of the engine fuel control device according to the preferred embodiment.

FIG. 7 shows a detailed configuration of the speed correction share calculation block shown in FIG. 5.

Referring to FIG. 7, blocks 701, 702, and 703 determine an engine coolant temperature at starting. The engine coolant temperature at starting is retained as the engine coolant temperature until the block 701 determines that there is a complete explosion. When the complete explosion is determined, a switch 702 changes a position thereof and a delay device 703 holds a preceding engine coolant temperature as the engine coolant temperature at starting. A block 705 is a speed correction share map set for the condition, in which the external load is turned OFF, while a block 706 is a speed correction share map set for the condition, in which the external load is turned ON. Each of these maps is searched through with the engine speed and the starting coolant temperature used as keys. An output of a map value when the external load is OFF or ON is produced as the speed correction share of the air bleed valve opening after having gone through a selection by a switch 704.

Figure 8:
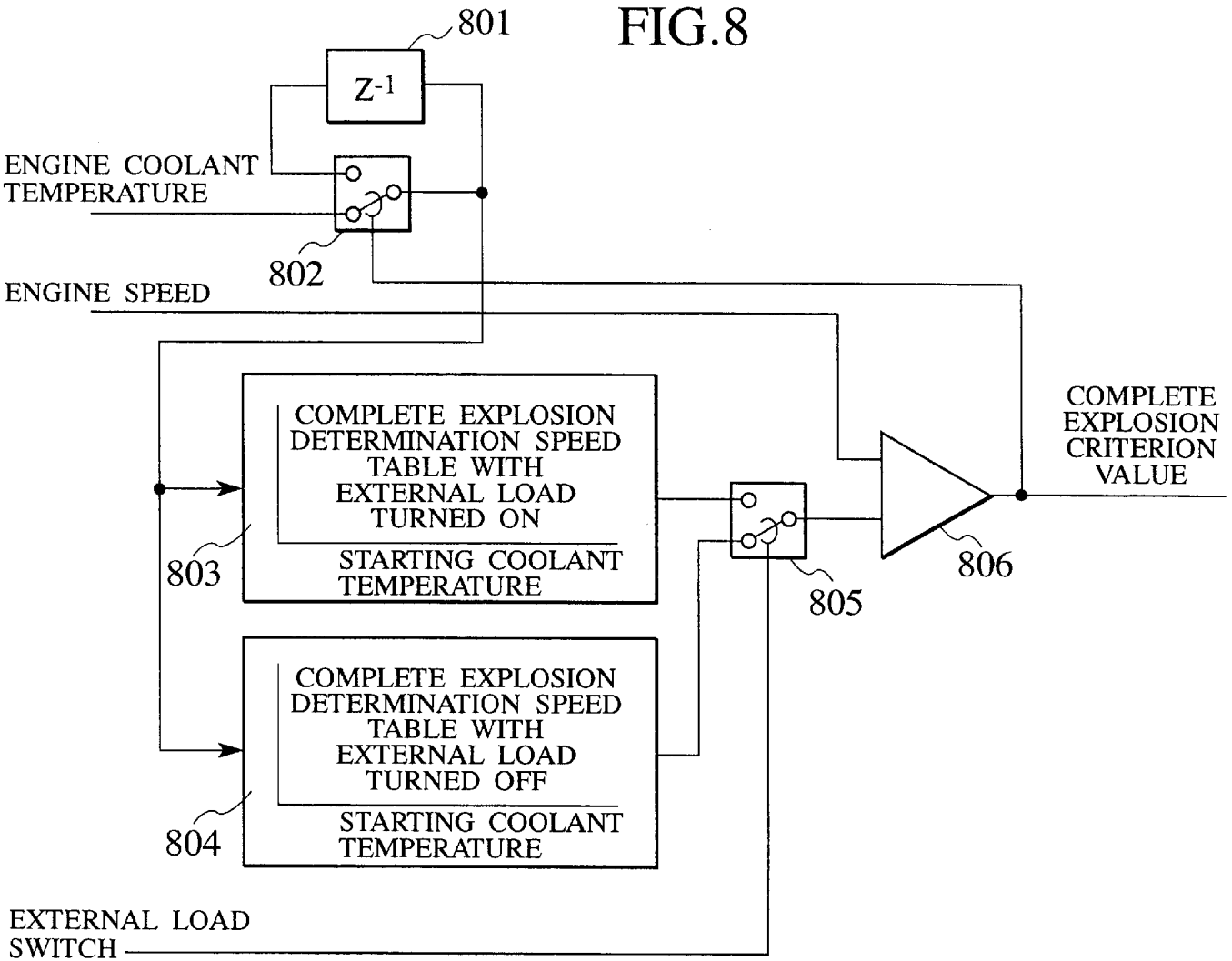
FIG. 8 shows a detailed configuration of a complete explosion determination block of the engine fuel control device according to the preferred embodiment.

FIG. 8 shows a detailed configuration of the complete explosion determination block shown in FIG. 5.

Referring to FIG. 8, blocks 801 and 802 determine the engine coolant temperature at starting as in the example shown in FIG. 7. According this embodiment, the engine coolant temperature is retained according to a complete explosion determination value to be output and that temperature is taken as the engine coolant temperature at starting. A block 803 is a complete explosion determination speed table set for the condition, in which the external load is turned OFF. A block 804 is a complete explosion determination speed table set for the condition, in which the external load is turned ON. A switch 805 selects the table value when the external load is OFF or ON and a comparator 806 compares the value with a current engine speed. If it is determined that the current engine speed is higher than a complete explosion determination speed corresponding to the case where the external load is OFF or ON, the configuration determines that it is the state of complete explosion. The decision once made of the state of complete explosion is not canceled until a condition, in which the engine stalls, develops where there are no signals applied from the crank angle sensor for a predetermined period of time.

Figure 9:
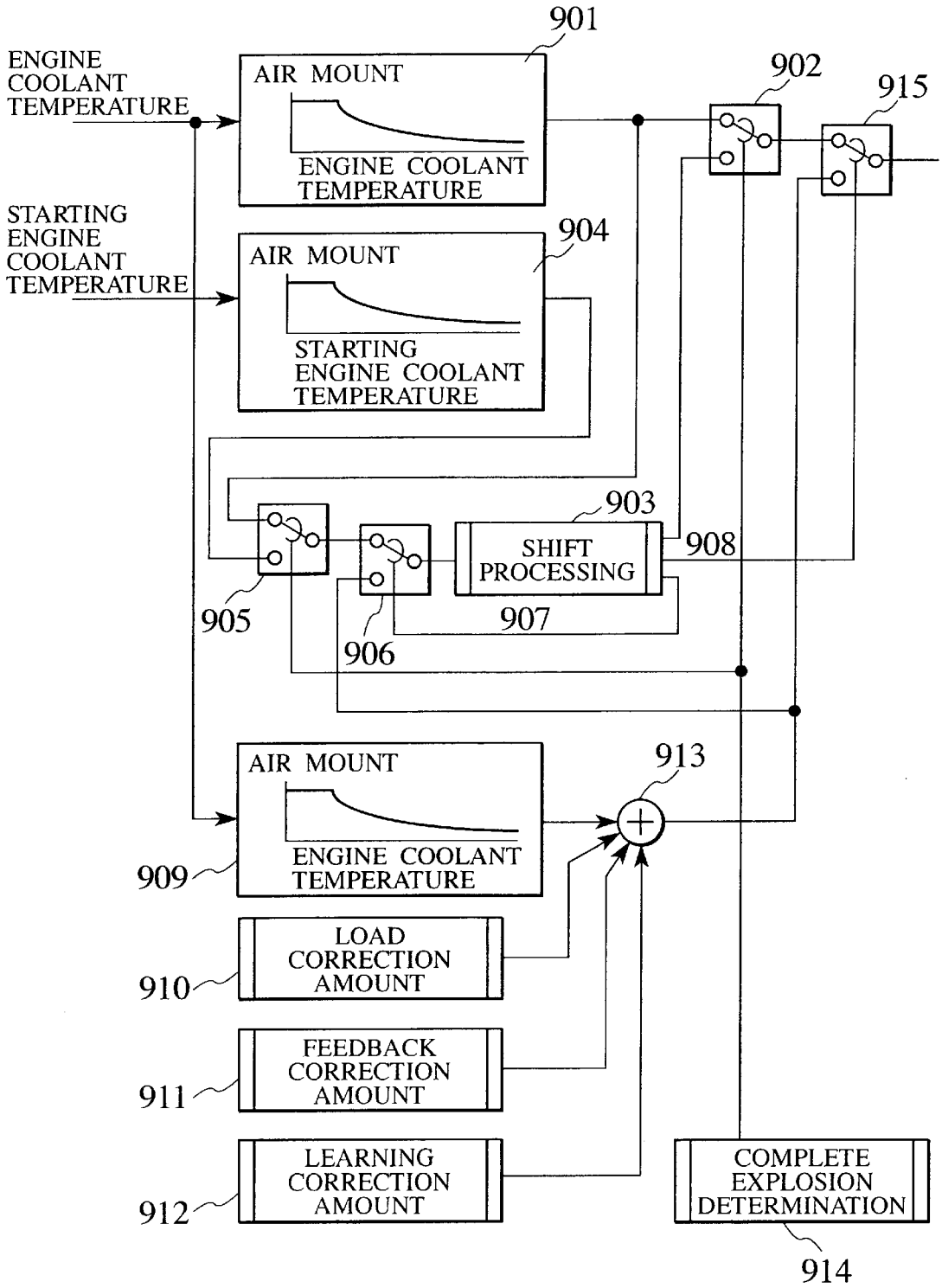
FIG. 9 shows a configuration of an ISC valve opening calculation block at the time of starting of the engine fuel control device according to the preferred embodiment.

FIG. 9 shows a calculation block for the ISC valve opening during starting.

Referring to FIG. 9, a block 914 is the complete explosion determination block. Until the block 914 determines that there is a complete explosion, the ISC valve opening before the complete explosion set through an engine coolant temperature table of a block 901 is output by way of switches 902 and 915. When the block 914 determines that there is a complete explosion, the switch 902 changes a position thereof and an output of a shift processing value of a block 903 is produced by way of the switches 902 and 915 as the ISC valve opening. A final value, which the shift processing value of the block 903 eventually reaches, is set by way of a switch 905 to a shift ISC valve opening target value after the complete explosion that is set through an at-starting engine coolant temperature table of a block 904 after the block 914 has determined that there is a complete explosion.

When the shift processing value of the block 903 reaches the shift ISC valve opening target value after the complete explosion of the block 904, a first shift processing completion signal 907 is output. Then, the final value that the shift processing value of the block 903 eventually reaches is switched by way of a switch 906 to the ISC valve opening after the complete explosion. The ISC valve opening after the complete explosion represents the sum of a table value set through an engine coolant temperature table of a block 909, a load correction amount of a block 910, a feedback correction amount of a block 911, and a learning correction amount of a block 912, all added up by an adder 913. When the shift processing value of the block 903 reaches the ISC valve opening after the complete explosion, a second shift processing completion signal 908 is output. This changes the position of a switch 915, causing the ISC valve opening after the complete explosion to be output at all times.

Figure 10:
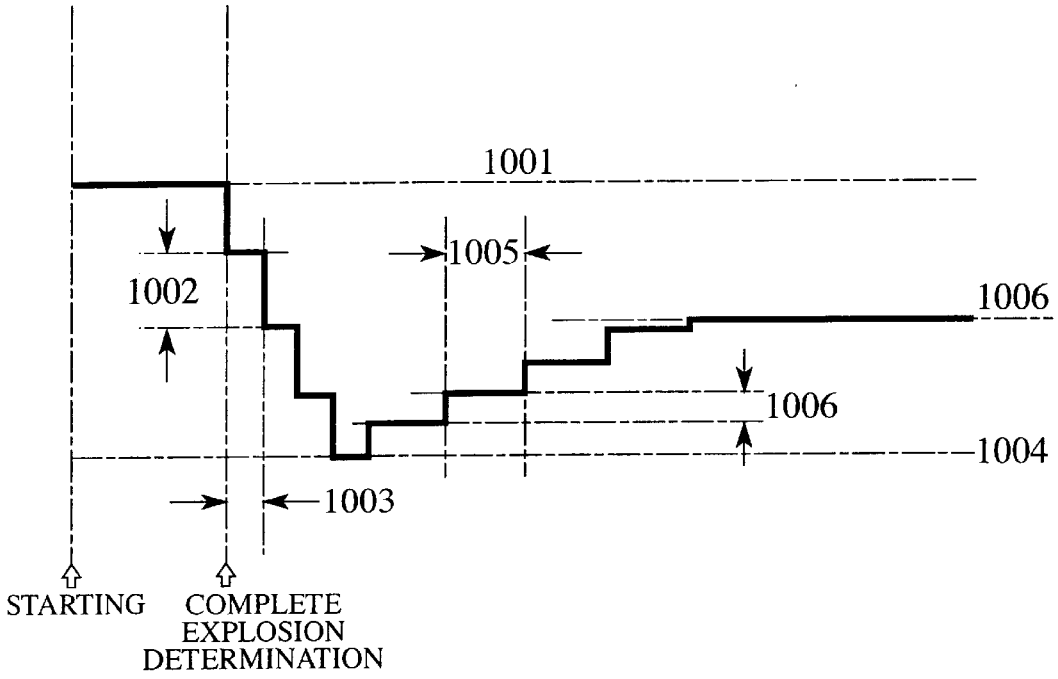
FIG. 10 shows ISC valve opening shift processing at the time of starting of the engine fuel control device according to the preferred embodiment.

FIG. 10 shows a shift processing of the ISC valve opening at starting shown in FIG. 9.

As shown in FIG. 10, an ISC valve opening before the complete explosion 1001 is maintained for the period from starting to complete explosion. When it is determined that there is a complete explosion, the ISC valve opening shifts toward a shift ISC valve opening target value after the complete explosion 1004 with increments of a shift amount 1002 for every period of time 1003. After the shift ISC valve opening target value after the complete explosion 1004 has been reached, the ISC valve opening shifts toward an ISC valve opening after the complete explosion 1006 with increments of a shift amount 1006 for every period of time 1005. The periods of time for shifting 1003 and 1005 and the shift amounts 1002 and 1006 are constants that can be adapted in accordance with actual engine behavior. They may not necessarily be one constant. Rather, they may be table search values that vary with different engine coolant temperatures.

Figure 11:
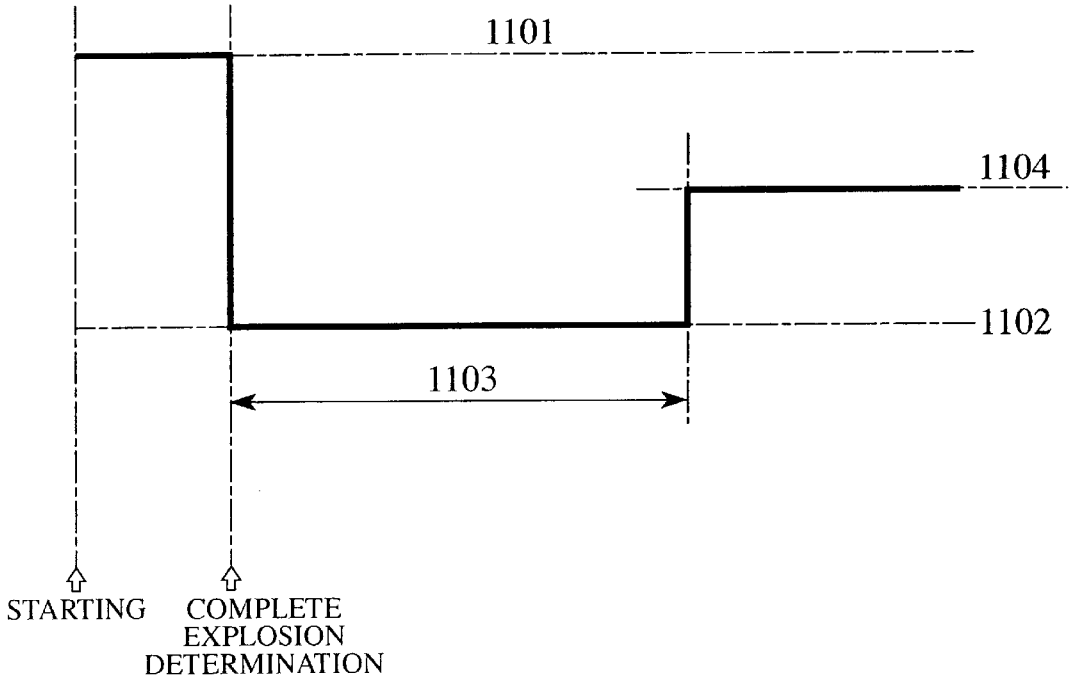
FIG. 11 shows another example of the ISC valve opening shift processing at the time of starting of the engine fuel control device according to the preferred embodiment.

FIG. 11 shows another example of the shift processing of the ISC valve opening at starting shown in FIG. 9. It differs from the example shown in FIG. 10 in that the complicated damping processing to arrive at the opening target value is omitted. In the same manner as in the example shown in FIG. 10, an ISC valve opening before the complete explosion 1101 is maintained for the period from starting to complete explosion. When it is determined that there is a complete explosion, the ISC valve opening directly becomes a shift ISC valve opening target value after the complete explosion 1102. The shift ISC valve opening target value after the complete explosion 1102 is maintained for a predetermined period of time 1103 before becoming an ISC valve opening after the complete explosion 1104. As in the example shown in FIG. 10, the predetermined period of time 1103 and the like are constants that can be adaptable according to the actual engine behavior.

Figure 12:
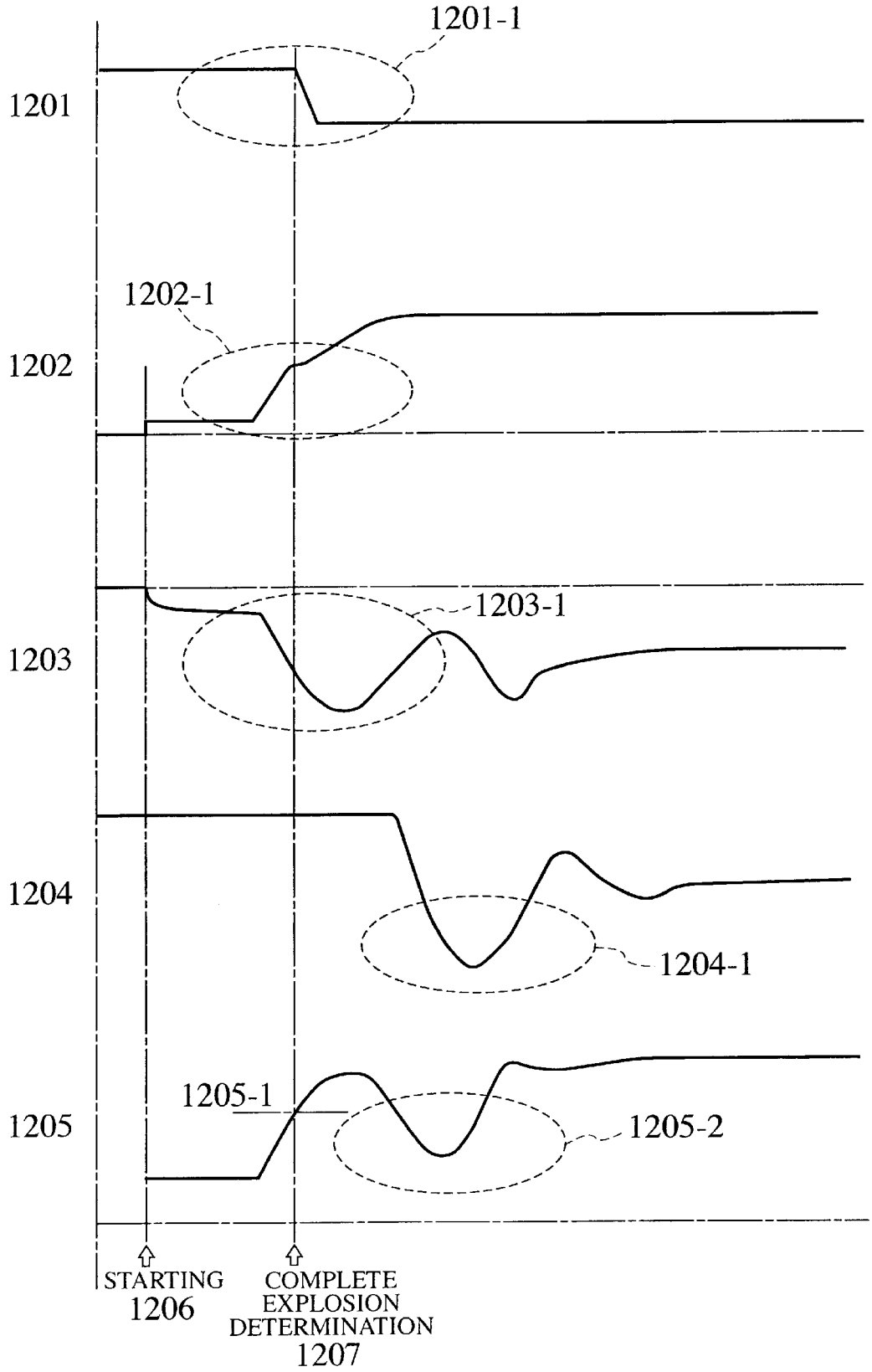
FIG. 12 shows a behavior pattern of engine starting when the ISC valve control method at the time of starting of the venturi type fuel supply device is not provided.

FIG. 12 shows a behavior pattern of engine starting when the ISC valve control method at the time of starting of the venturi type fuel supply device is not provided.

Referring to FIG. 12, different charts show behavior patterns of different elements as follows. Namely, chart 1201 shows a behavior pattern of the ISC valve opening, chart 1202 that of the air bleed valve opening, chart 1203 that of the venturi chamber negative pressure, chart 1204 that of the air-fuel ratio, and chart 1205 that of the engine speed. A complete explosion is determined when the engine speed 1205 exceeds a complete explosion determination engine speed 1207, which causes the ISC valve opening 1201 to shift from the ISC valve opening before the complete explosion to the ISC valve opening after the complete explosion (region 1201_1). The air bleed valve opening 1202 shifts from the opening before the complete explosion to the opening after the complete explosion accompanying the engine speed correction share (region 1202_1). The behavior pattern of the venturi chamber negative pressure exhibits a sudden drop as the engine speed increases after the complete explosion (region 1203_1). As the venturi chamber negative pressure changes, there is a sudden increase in the amount of mixture gas taken in, causing the air-fuel ratio 1204 to become excessively rich (region 1204_1). The excessively rich air-fuel ratio aggravates combustion, causing the engine speed 1205 to drop immediately after starting (region 1205_2).

Figure 13:
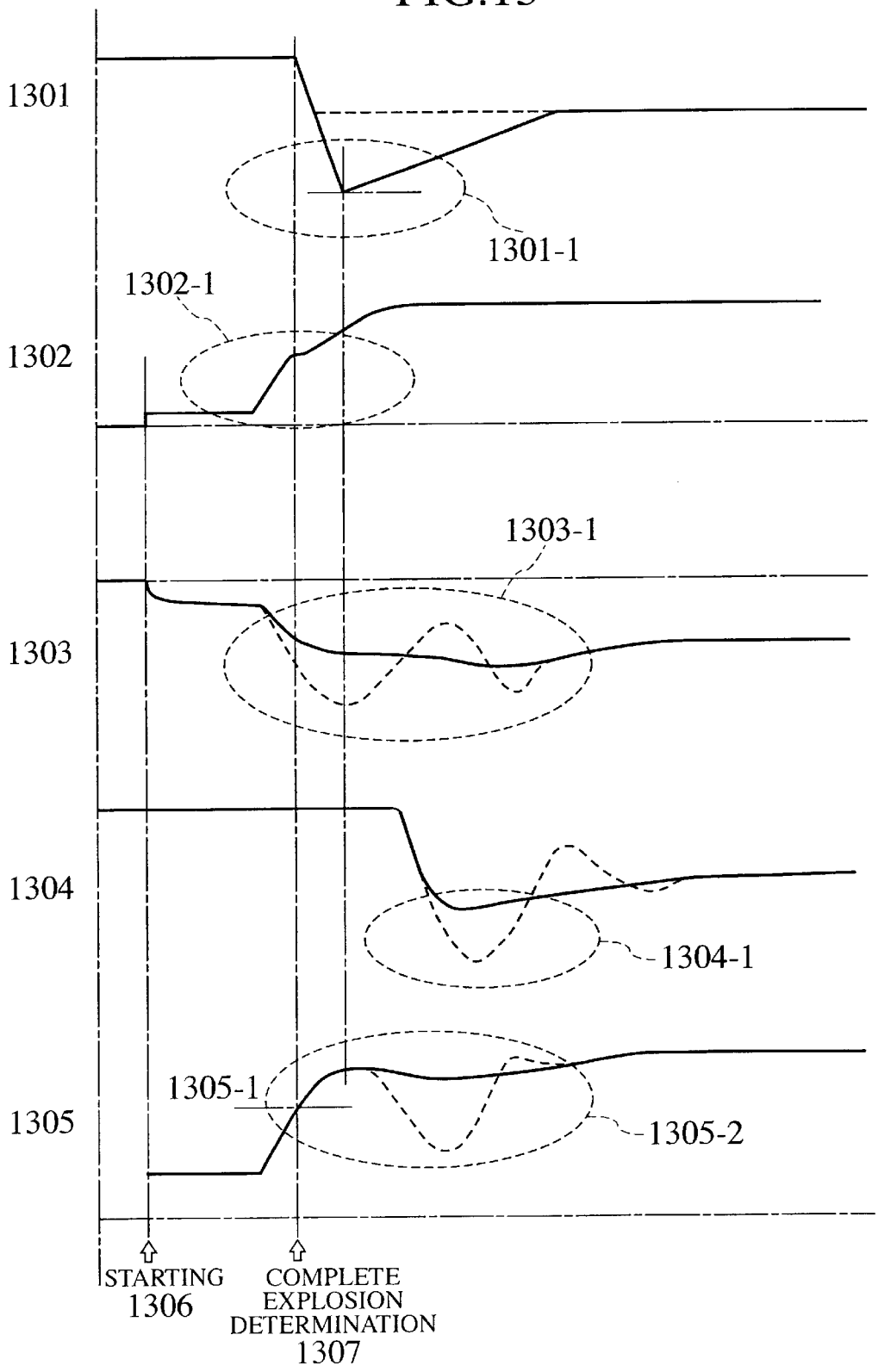
FIG. 13 shows a behavior pattern of engine starting when the ISC valve control method at the time of starting of the venturi type fuel supply device is provided.

FIG. 13 shows a behavior pattern of engine starting when the ISC valve control method at the time of starting of the venturi type fuel supply device is provided. Like the example shown in FIG. 12, chart 1301 shows a behavior pattern of the ISC valve opening, chart 1302 that of the air bleed valve opening, chart 1303 that of the venturi chamber negative pressure, chart 1304 that of the air-fuel ratio, and chart 1305 that of the engine speed. After the complete explosion has been determined as a result of the increase in the engine speed 1305, the ISC valve opening 1301 temporarily shifts from the ISC valve opening before the complete explosion to a shift ISC valve opening target value after the complete explosion 1301_1 before thereafter becoming the ISC valve opening after the complete explosion (region 1301_2). This makes a sudden drop in the venturi chamber negative pressure milder (region 1303_1), which prevents the air-fuel ratio from becoming excessively rich as is the case with the example shown in FIG. 12 (region 1304_1). When the air-fuel ratio is prevented from becoming excessively rich, it eliminates the drop in the engine speed 1305 as it occurs immediately after the engine has been started in the example shown in FIG. 12 (region 1305_2).

Figure 14:
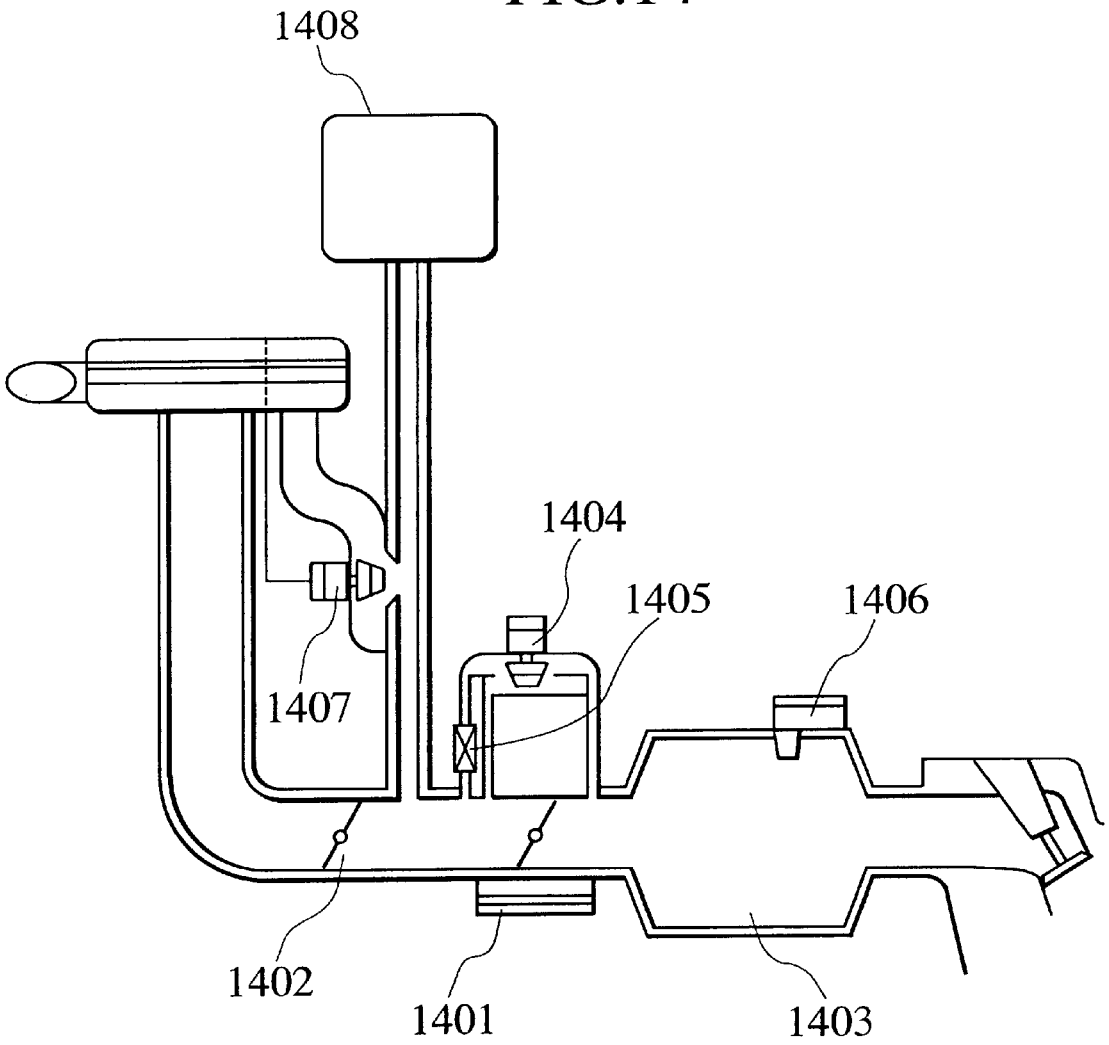
FIG. 14 shows another example of configuration of parts surrounding the venturi chamber of the venturi type fuel supply device.

FIG. 14 shows another example of configuration of parts surrounding the venturi chamber of the venturi type fuel supply device. The example differs from that of the configuration of parts surrounding the venturi chamber shown in FIG. 2 in that, there is further provided, around an idle speed control valve that controls the flow path area of a flow path connected to an intake pipe 1403 and thus the engine idle speed by bypassing a throttle valve 1401, a bypass valve 1405 that bypasses the idle speed control valve 1404. The configuration of other parts is the same as that shown in FIG. 2, including the throttle valve 1401, a choke valve 1402, an intake pipe 1403, the idle speed control valve 1404, an intake pipe pressure sensor 1406, an air bleed valve 1407, and a regulator 1408.

Figure 15:
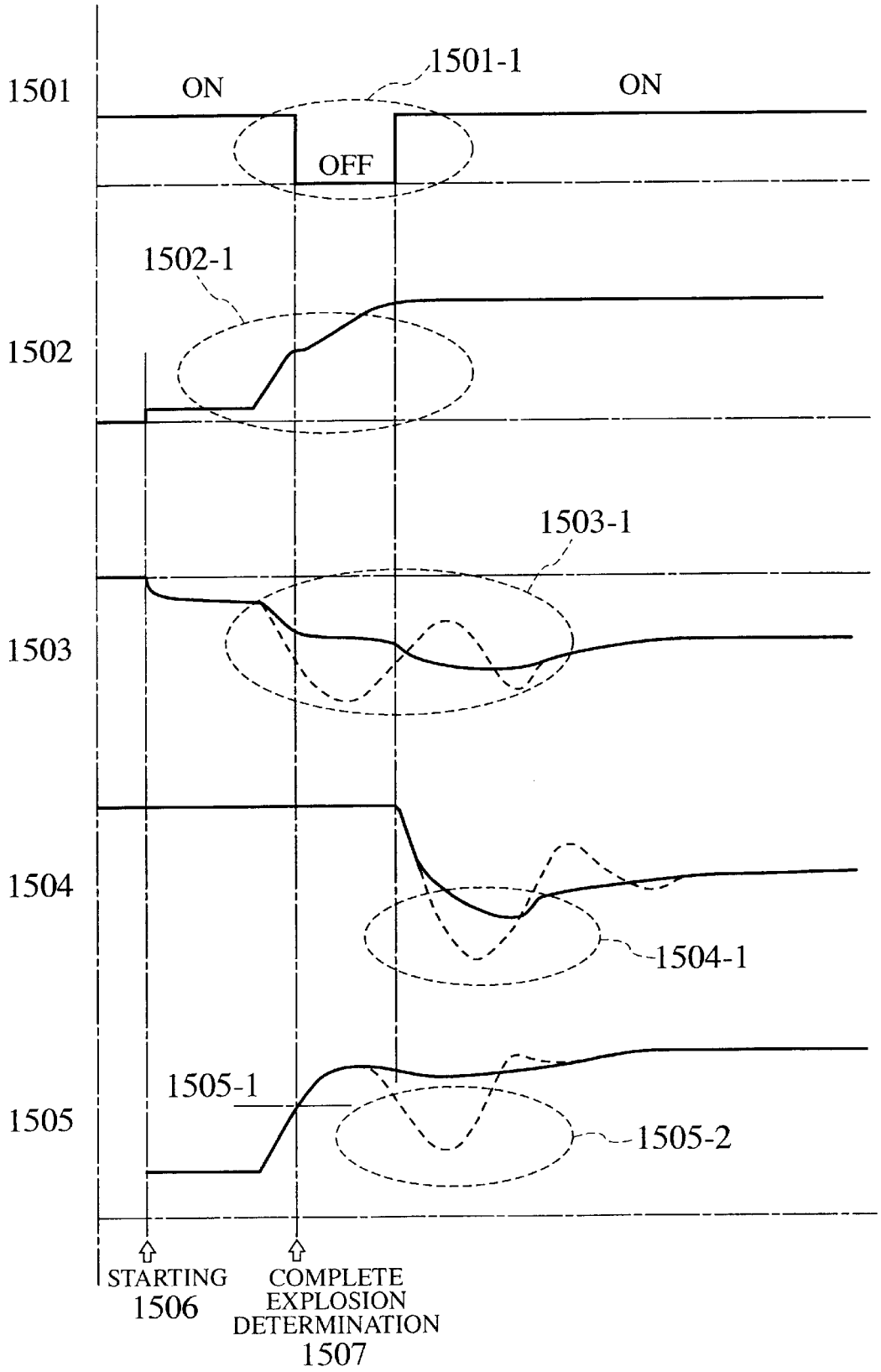
FIG. 15 shows a behavior pattern of engine starting in the configuration of parts around the venturi chamber of the engine fuel control device according to the preferred embodiment.

FIG. 15 shows a behavior pattern of engine starting in the configuration of parts around the venturi chamber as shown in FIG. 14. Referring to FIG. 15, different charts show behavior patterns of different elements as follows. Namely, chart 1501 shows a behavior pattern of the bypass valve, chart 1502 that of the air bleed valve opening, chart 1503 that of the venturi chamber negative pressure, chart 1504 that of the air-fuel ratio, and chart 1505 that of the engine speed. After the complete explosion has been determined as a result of the increase in the engine speed 1505, control is provided so as to close the bypass valve for a predetermined period of time (region 1501_1). Closing the bypass valve helps make a sudden drop in the venturi chamber negative pressure milder (region 1503_1), which prevents the air-fuel ratio from becoming excessively rich as is the case with the example shown in FIG. 12 (region 1504_1). When the air-fuel ratio is prevented from becoming excessively rich, it eliminates the drop in the engine speed 1505 as it occurs immediately after the engine has been started in the example shown in FIG. 12 (region 1505_2).

Figure 16:
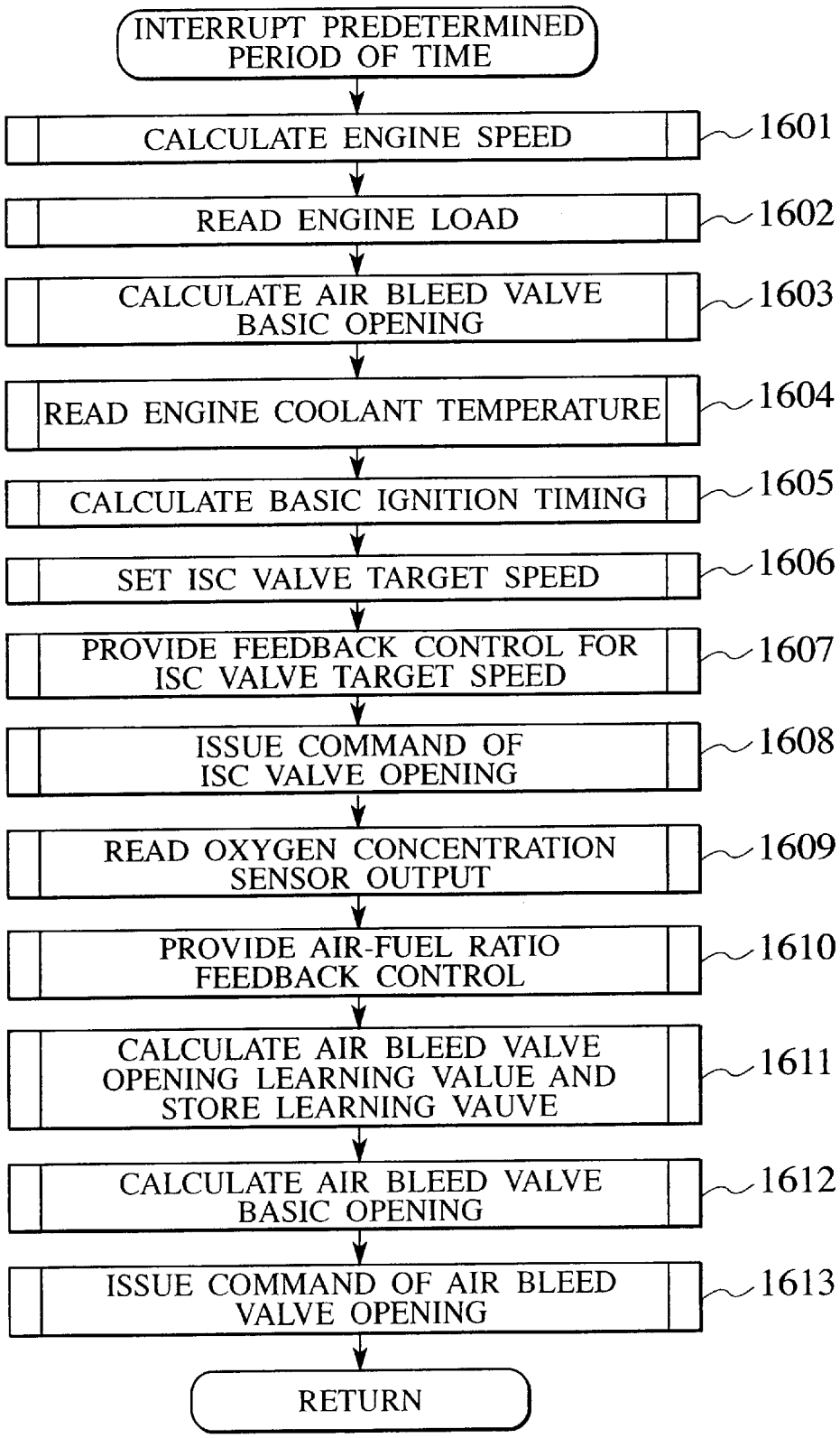
FIG. 16 shows a flowchart of control provided by the fuel control device provided with the ISC valve control method at the time of starting of the venturi type fuel supply device according to the preferred embodiment.

FIG. 16 shows a flowchart of control provided by the fuel control device provided with the ISC valve control method at the time of starting of the venturi type fuel supply device.

In step 1601, the engine speed is calculated based on a signal provided by the crank angle sensor. In step 1602, the engine load, such as the intake pipe pressure and the like, is read. In step 1603, the air bleed valve basic opening is calculated. In step 1604, the engine coolant temperature according to an output provided by the coolant temperature sensor is read. In step 1605, the basic ignition timing is calculated based on the engine speed, the engine load, and the engine coolant temperature. In step 1606, a target speed during idling is set according to the engine condition. In step 1607, a feedback control is provided for the ISC valve opening so as to achieve the set target idle speed and, in step 1608, a command is issued for the ISC valve opening. In step 1609, the output from the oxygen concentration sensor mounted to the exhaust pipe of the engine is read and, in step 1610, an air-fuel ratio feedback control is provided according to the reading of the oxygen concentration sensor output. In step 1611, the air bleed valve opening learning value based on the result of the air-fuel ratio feedback control is calculated and stored accordingly. In steps 1612 and 1613, the air bleed valve opening learning value and the like are incorporated, the air bleed valve basic opening is calculated, and a command is issued for the air bleed valve opening. A sequence of these operations is executed at every predetermined period of time according to the embodiment. It may nonetheless be executed by an event request from the engine, for example, at every predetermined crank angle.

Figure 17:
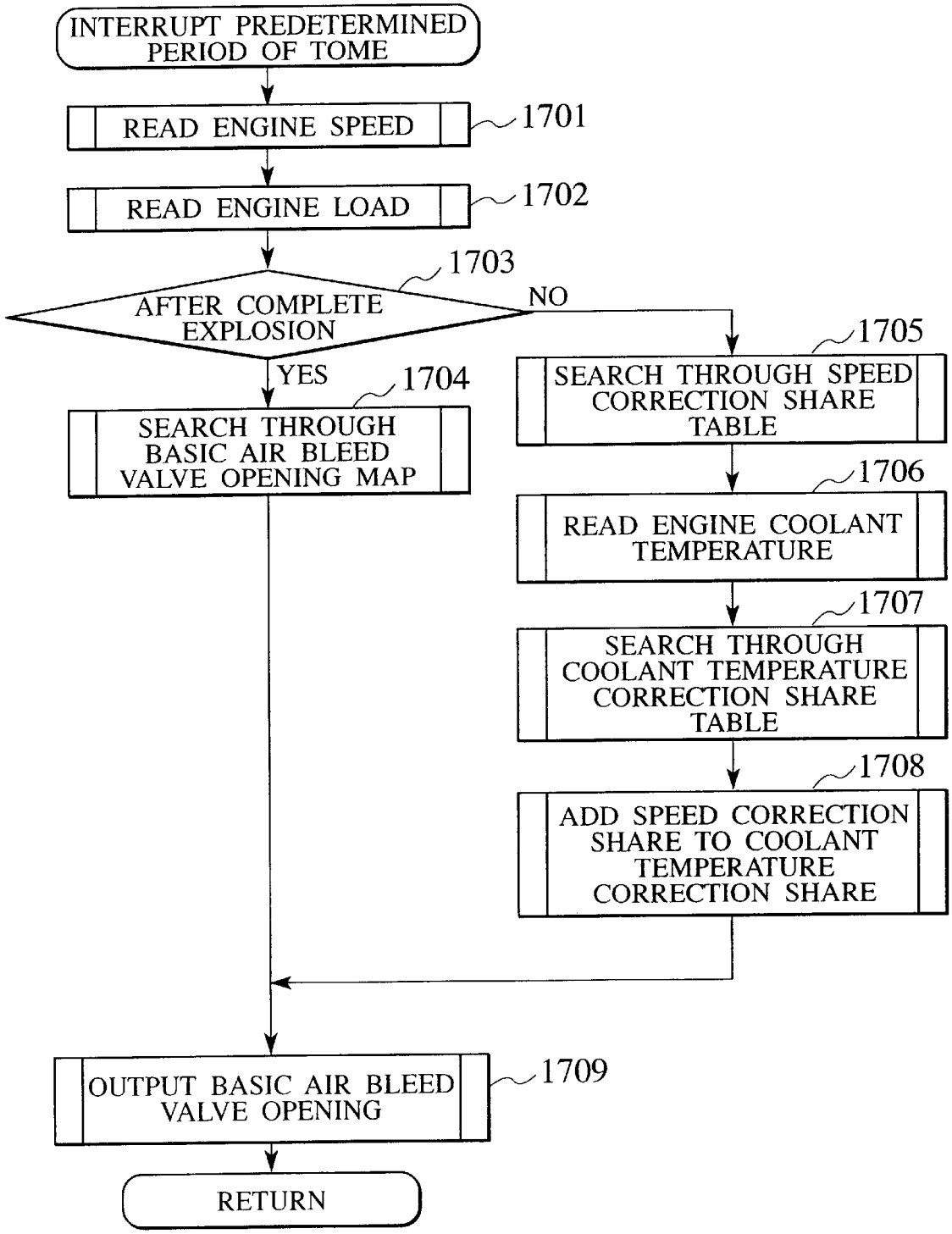
FIG. 17 is an entire flowchart for the air bleed valve opening calculation block of the engine fuel control device according to the preferred embodiment.

FIG. 17 is an entire flowchart for the air bleed valve opening calculation block shown in FIG. 5.

In step 1701, the engine speed is read. In step 1702, the engine load is read. In step 1703, it is determined whether the engine is in a complete explosion state or not. If it is determined that the engine is in the complete explosion state, a search is done through a map for the basic air bleed valve opening in step 1704. If it is determined that the engine is not in the complete explosion state in step 1703, then a search is done through a table for the share of the engine speed correction and the share of the coolant temperature correction with respect to the air bleed valve opening in steps 1705, 1706, 1707, and 1708. The sum of these parameters is the basic air bleed valve opening. In step 1709, an output is produced of the basic air bleed valve opening corresponding to the complete explosion or an incomplete explosion state.

Figure 18:
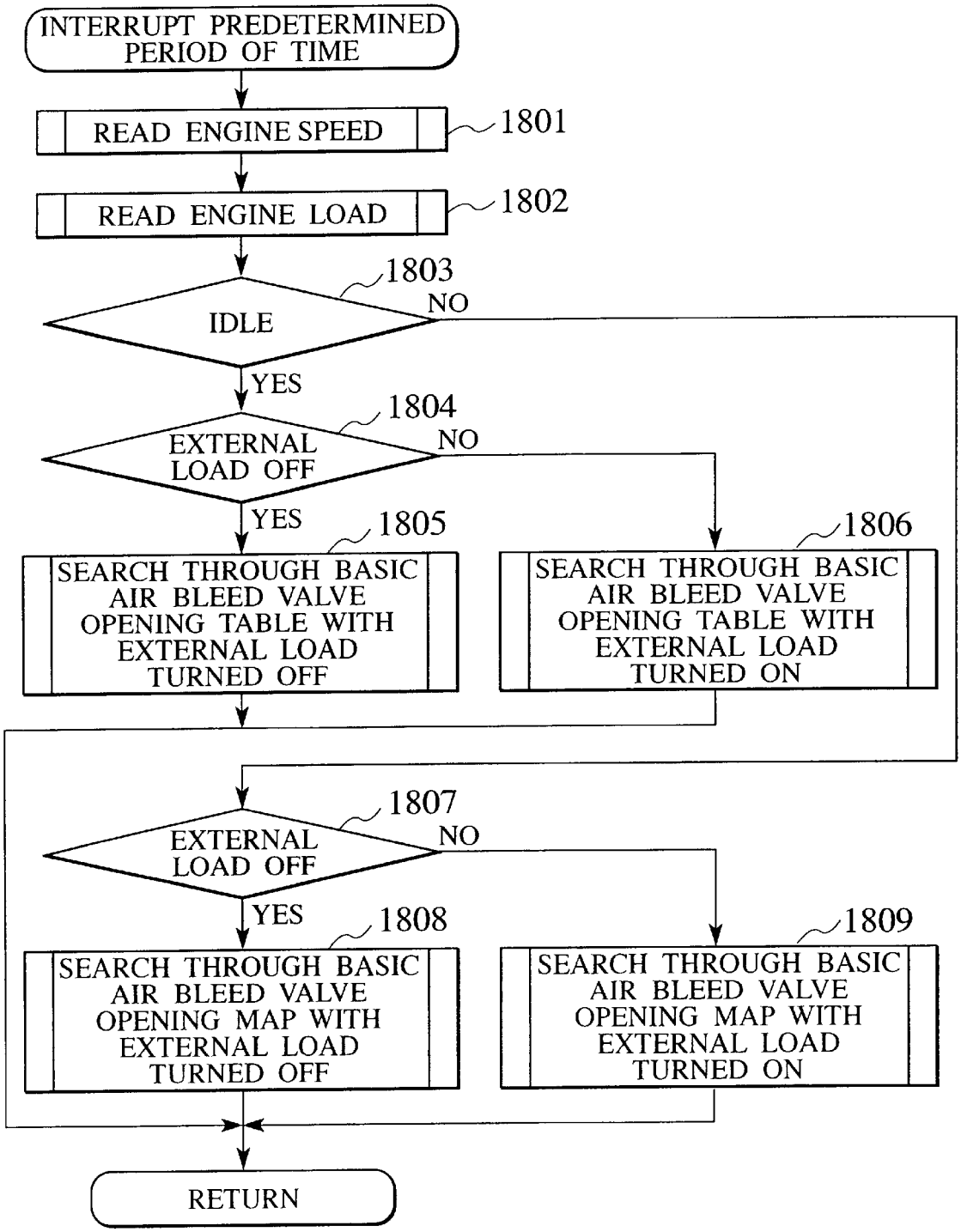
FIG. 18 is a flowchart for the basic air bleed valve opening calculation block of the engine fuel control device according to the preferred embodiment.

FIG. 18 is a flowchart for the basic air bleed valve opening calculation block shown in FIG. 5.

In step 1801, the engine speed is read. In step 1802, the engine load is read. In step 1803, it is determined whether the engine is in the idle state or not. If it is determined that the engine is in the idle state, a search is done through a table according to the engine speed for the basic air bleed valve opening corresponding to an external load based on a decision made in step 1804 whether or not the external load is OFF (steps 1805 and 1806). If it is determined that the engine is not in the idle state in step 1803, a search is done through a map according to the engine speed and the engine load for the basic air bleed valve opening corresponding to the external load based on a decision made in step 1807 whether or not the external load is OFF (steps 1808 and 1809).

Figure 19:
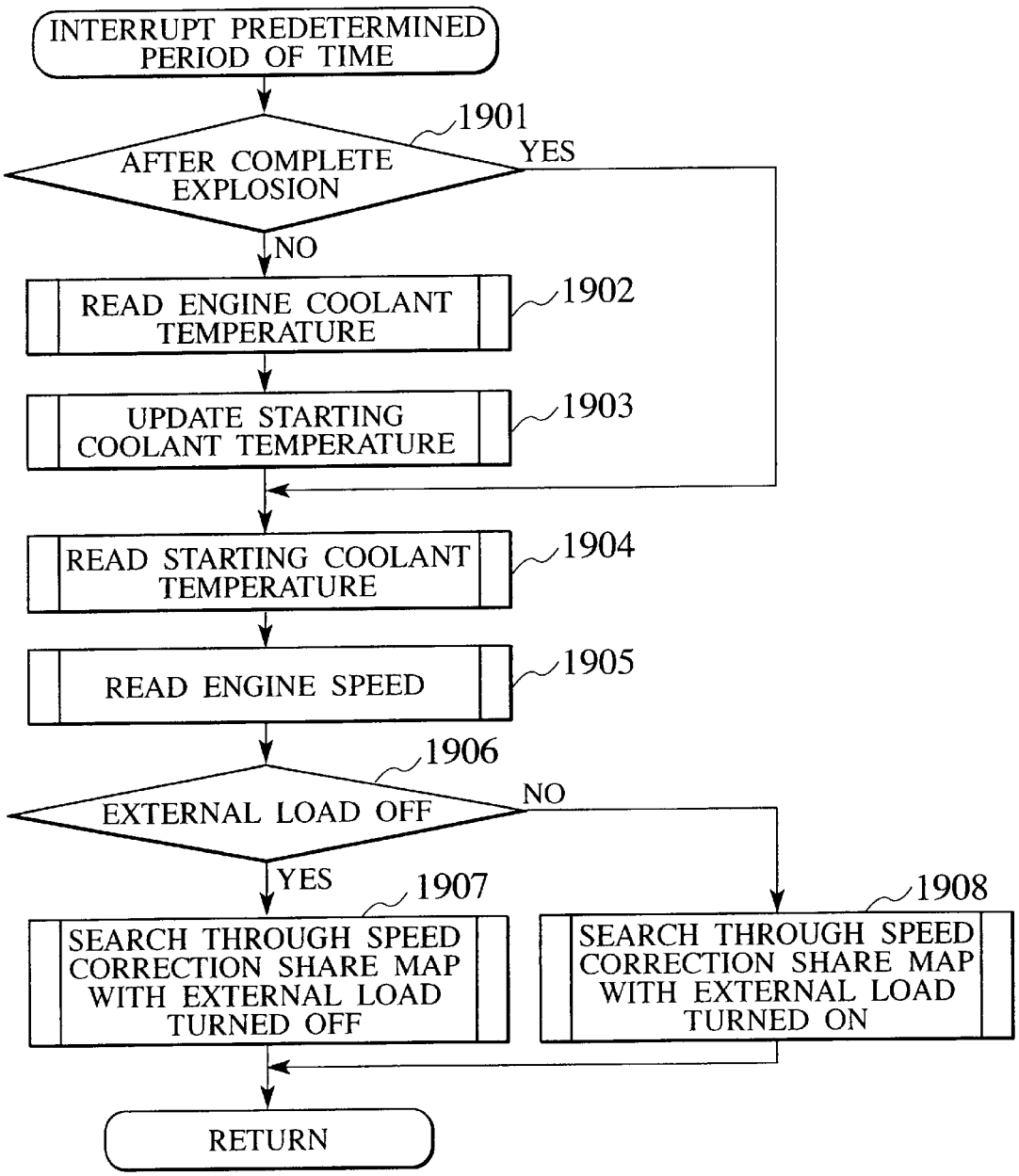
FIG. 19 is a flowchart for the speed correction share calculation block of the engine fuel control device according to the preferred embodiment.

FIG. 19 is a flowchart for the speed correction share calculation block shown in FIG. 5. Steps 1901, 1902, and 1903 show a flow for setting the coolant temperature at starting.

In step 1901, it is determined whether the engine is in a phase of after complete explosion or not. The engine coolant temperature is read and updated as the coolant temperature at starting until it is determined that the engine is in the phase of complete explosion (steps 1902 and 1903). Since the coolant temperature at starting is not updated after the complete explosion, the engine coolant temperature immediately after the complete explosion is retained as the starting coolant temperature at starting. In step 1904, the coolant temperature at starting is read and, in step 1905, the engine speed is read. In steps 1906, 1907, and 1908, a search is done through a map according to the coolant temperature at starting and the engine speed for a speed correction share corresponding to whether the external load is OFF or not.

Figure 20:
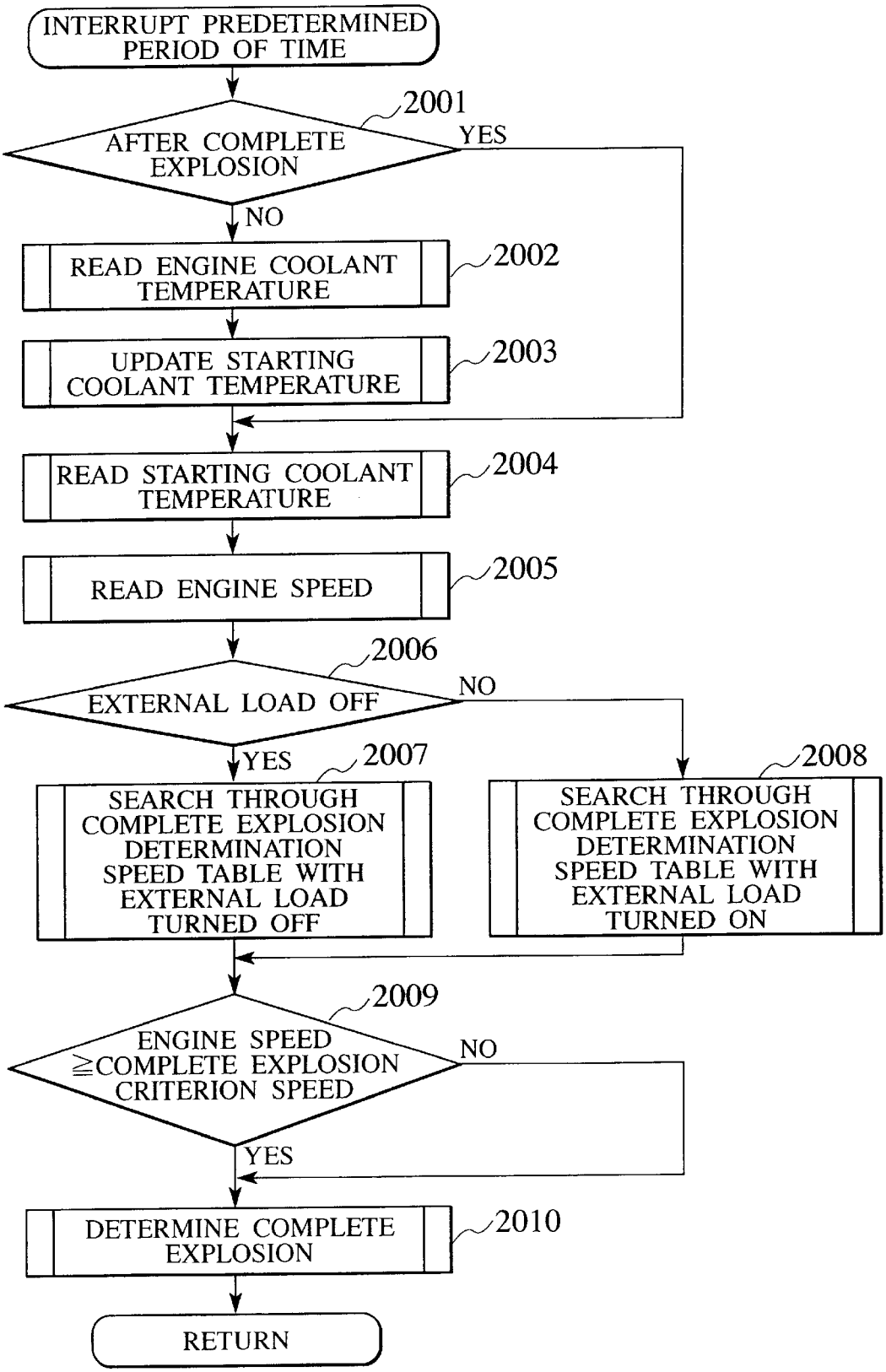
FIG. 20 is a flowchart for steps followed when determining the complete explosion in the engine fuel control device according to the preferred embodiment.

FIG. 20 is a flowchart for steps followed when determining the complete explosion shown in FIG. 5. Steps 2001, 2002, and 2003 are the same as those for setting the coolant temperature at starting in the example shown in FIG. 19.

In step 2004, the set at-starting coolant temperature is read. In step 2005, the engine speed is read. In steps 2006, 2007, and 2008, a search is done through a complete explosion determination speed table corresponding to whether the external load is OFF or not with the coolant temperature at starting used as the key. In step 2009, a current engine speed is compared with the complete explosion determination speed. If it is determined that the current engine speed is higher than the complete explosion determination speed, it is determined that there is the complete explosion in step 2010.

Figure 21:
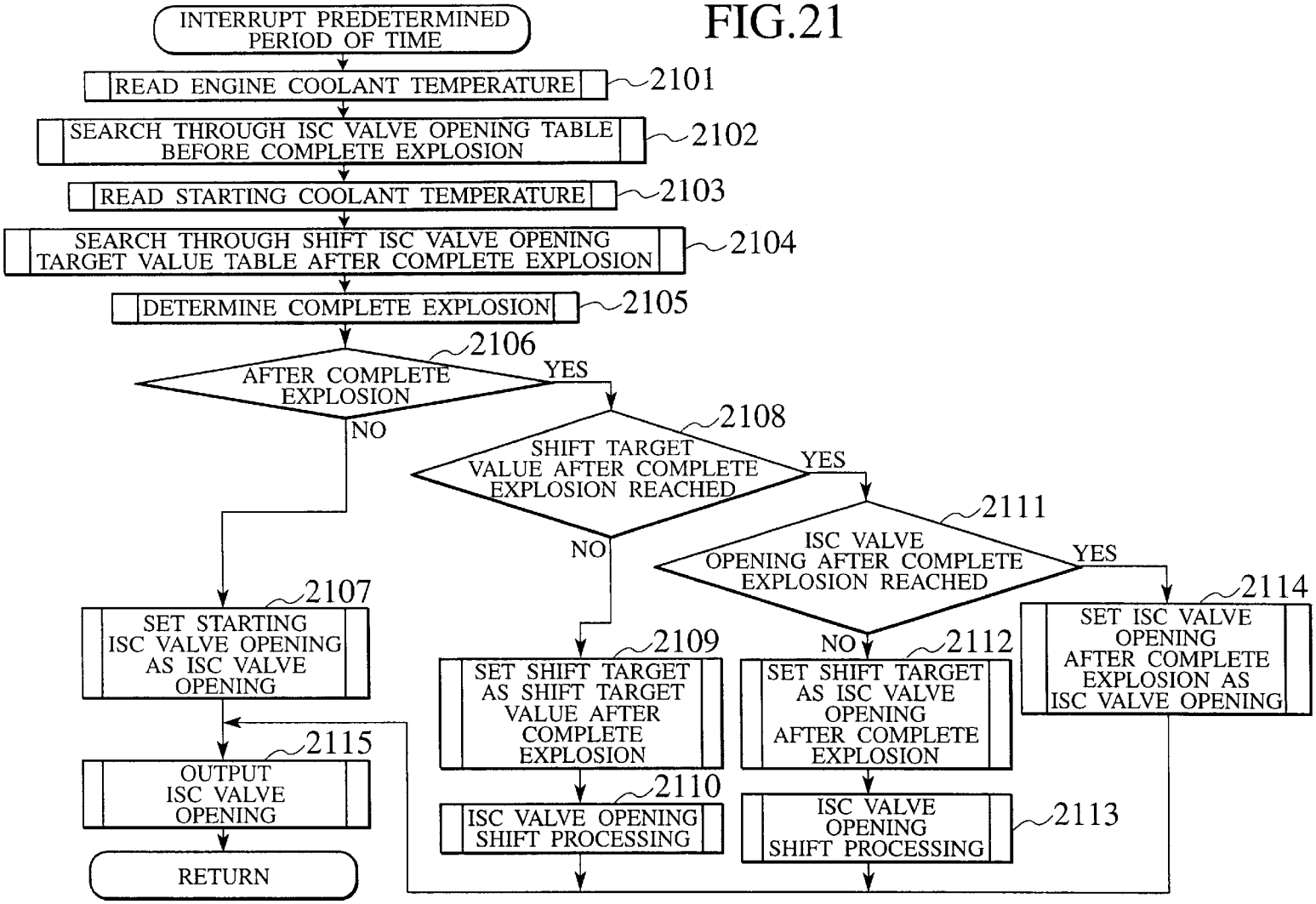
FIG. 21 is a flowchart for the ISC valve opening calculation block at the time of starting of the engine fuel control device according to the preferred embodiment.

FIG. 21 is a flowchart for the at-starting ISC valve opening calculation block.

In step 2101, an engine coolant temperature is read. In step 2102, a search is done through a table for the ISC valve opening before complete explosion with the engine coolant temperature used as the key. In step 2103, an engine coolant temperature at starting is read. In step 2104, a search is done through a table for a shift ISC valve opening target value after the complete explosion with the coolant temperature at starting used as the key. In step 2105, a complete explosion decision shown in FIG. 20 is made. If it is determined in step 2105 that there is not the complete explosion, the ISC valve opening before the complete explosion is selected. If it is determined in step 2105 that there is the complete explosion, it is determined in step 2108 whether the shift ISC valve opening target value after the complete explosion is reached or not. If it is determined that the shift ISC valve opening target value after the complete explosion is yet to be reached, shift processing to reach the shift ISC valve opening target value after the complete explosion is performed in steps 2109 and 2110. If it is determined that the shift ISC valve opening target value after the complete explosion has been reached in step 2108, it is determined in step 2111 whether the ISC value opening after the complete explosion is reached or not. If it is determined that the ISC valve opening after the complete explosion is yet to be reached, shift processing to reach the ISC valve opening after the complete explosion is performed in steps 2112 and 2113. If it is determined that the shift ISC valve opening target value after the complete explosion has been reached in step 2111, the ISC valve opening after the complete explosion is selected in step 2114. An output of the opening during the shift processing or one selected is produced as the ISC valve opening in step 2115.

Figure 22:
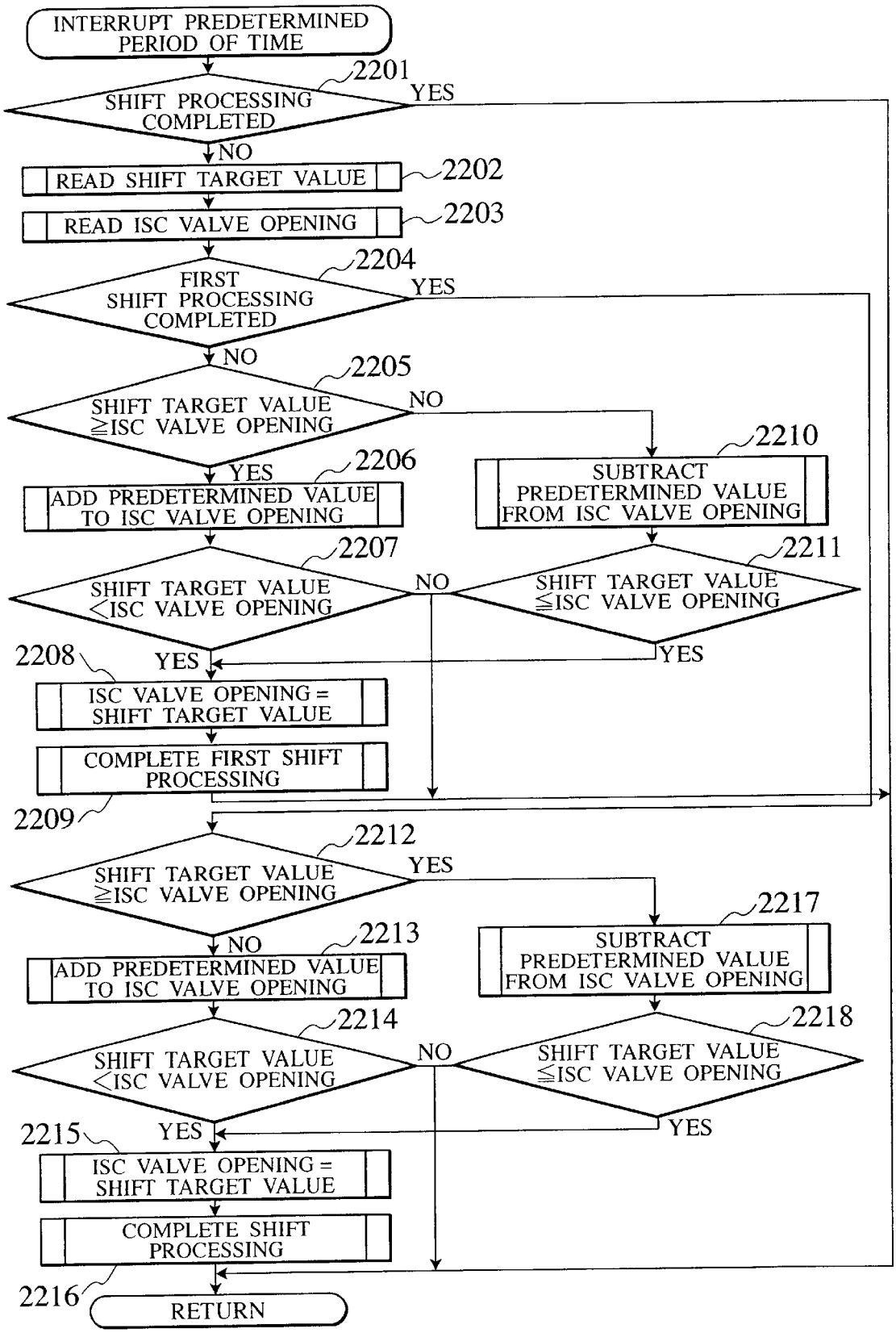
FIG. 22 is a flowchart for the shift processing of the ISC valve opening calculation block at the time of starting of the engine fuel control device according to the preferred embodiment.

FIG. 22 is a flowchart for the shift processing of the at-starting ISC valve opening calculation block.

In step 2201, it is determined whether all shift processing is completed or not. If it is determined that all shift processing is completed, the process is directly terminated. Steps 2202 through 2211 form steps for a first shift processing. In step 2202, an ISC valve opening shift target value is read. In step 2203, a current ISC valve opening is read. In step 2204, it is determined whether or not the first shift processing is completed. If it is determined that the first shift processing has been completed, a second shift processing shown as steps 2212 through 2218 is performed.

If it is determined in step 2204 that the first shift processing is yet to be completed, it is determined whether the current ISC valve opening is greater or smaller than the shift target value in step 2205. If it is determined that the current ISC valve opening is smaller than the shift target value, a predetermined value of opening is added in step 2206. If it is determined that the current opening is greater than the target value, a predetermined value of opening is subtracted in step 2210. When the relationship between the ISC valve opening and the shift target value is inverted from an original comparative result through addition and subtraction, the current ISC valve opening replaces the shift target value. It is then determined that the first shift processing is completed (steps 2208 and 2209).

When the first shift processing is completed, the second shift processing is performed. In the second shift processing, the shift target value is replaced by a second shift target value in step 2202. In the same manner as in the first shift processing, the second shift processing is performed through steps of comparison of values and addition and subtraction of a predetermined value (steps 2212, 2213, 2217, 2214, and 2218). As in the first shift processing, when the relationship between the ISC valve opening and the shift target value is finally inverted from the original comparative result at the start of the second shift processing through addition and subtraction, the current ISC valve opening replaces a final shift target value. It is then determined that all shift processing is completed (steps 2215 and 2216).

Figure 23:
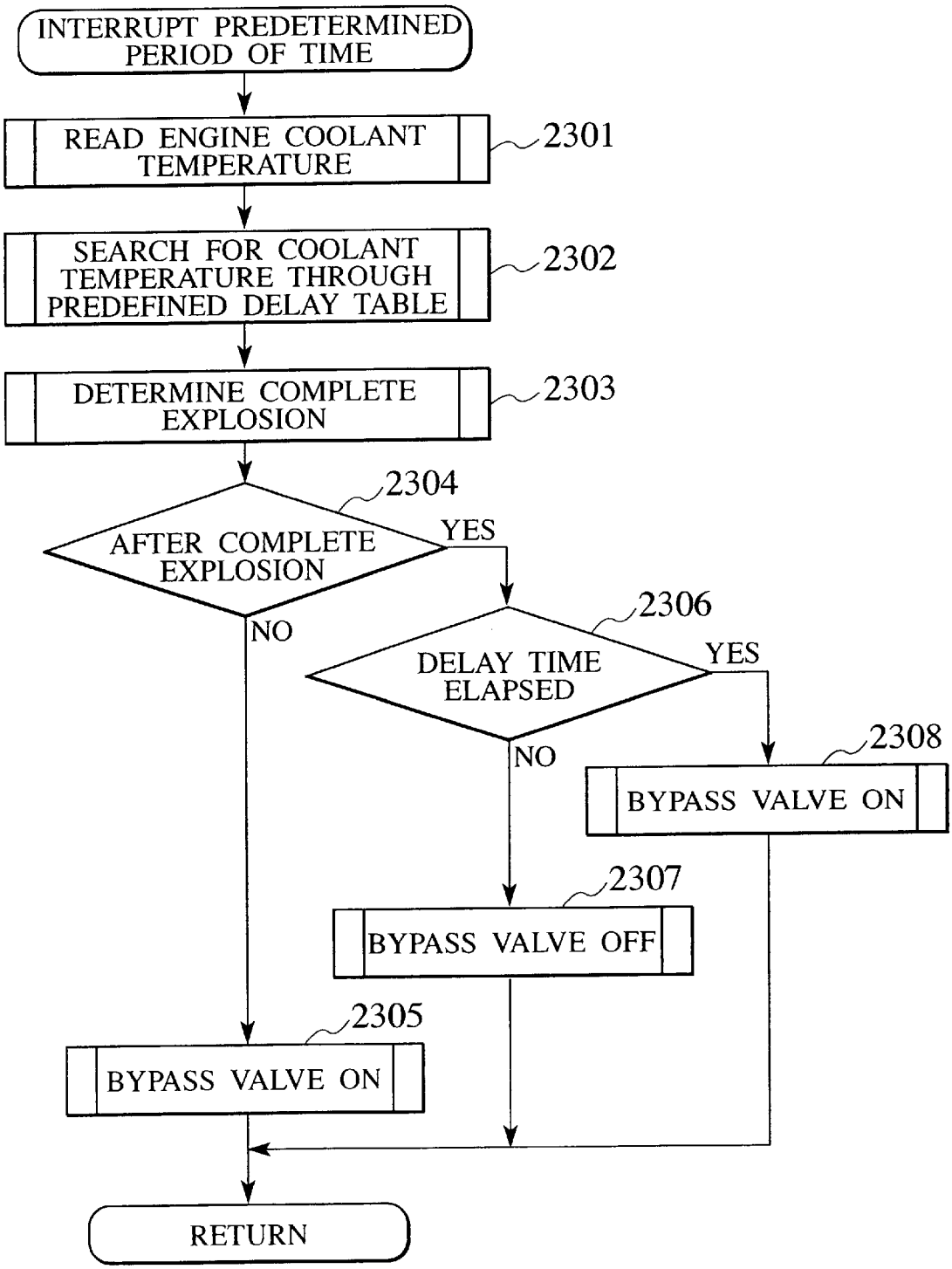
FIG. 23 shows a flowchart for the control provided in the configuration of parts around the venturi chamber of the engine fuel control device according to the preferred embodiment.

FIG. 23 shows a flowchart for the control provided in the configuration of parts around the venturi chamber as shown in FIG. 14.

In step 2301, an engine coolant temperature is read. In step 2302, a search is done through a table for a delay time corresponding to the engine coolant temperature. In step 2304, it is determined whether the engine is in a phase after complete explosion. If it is determined that the engine is not in the phase after complete explosion, a bypass valve is turned ON in step 2305. If it is determined in step 2304 that the engine is in the phase after complete explosion, it is further determined in step 2306 whether the delay time has elapsed or not. If the delay time is yet to elapse, the bypass valve is turned OFF in step 2307. If the delay time has elapsed, the bypass valve is turned ON in step 2308.

As explained in the foregoing descriptions, the engine fuel control device according to the preferred embodiment of the present invention is provided with the following components. They include: the throttle valve 202 disposed in the intake pipe 204 of the engine; the idle speed control valve 205 that is disposed in the bypass passage that bypasses the throttle valve 202; the starting phase determination means that determines whether the engine is in a pre-start phase or a post-start phase; the first opening setting means that sets the opening of the idle speed control valve before starting; the second opening setting means that sets the opening of the idle speed control valve after starting; and the target opening setting means that sets at least one target opening for the idle speed control valve opening when the engine shifts from the pre-start phase to the post-start phase. While the engine is being started, the fuel control device shifts the ISC valve opening from the opening before the complete explosion is determined to the target opening after the complete explosion and eventually to the opening after the complete explosion. It thereby controls changes in the venturi negative pressure occurring as a result of the increased speed of complete explosion and stabilizes the amount of fuel gas supplied during starting. Furthermore, it can prevent the air-fuel ratio after the engine has been started from becoming excessively rich, thus avoiding poor startability caused by aggravated combustion and a drop in the engine speed after the engine has been started.

While the invention has been described with reference to a preferred embodiment thereof, it is to be understood that the invention is not limited to the preferred embodiment. Rather, the invention is intended to cover various modifications in design within the spirit and scope of the invention as claimed.

For example, the engine control unit 214 according to the preferred embodiment uses the oxygen concentration sensor 212 that provides an output of an air-fuel ratio signal that is linear to the exhaust air-fuel ratio for providing the target speed feedback control by means of the ISC valve feedback control means 103 and for making the basic opening correction by the opening correction value calculation means 107. Instead of using this type of oxygen concentration sensor, an oxygen concentration sensor (not shown) that provides an output of a signal indicating that the exhaust gas of the engine 201 is on either the rich side or the lean side with respect to the stoichiometric air-fuel ratio.

Furthermore, according to the preferred embodiment, three control methods of a proportional control (P control), an integral control (I control), and a derivative control (D control) in the PID control are employed to obtain respective operation values through arithmetic operations performed of air-fuel ratio differences, which are added up to arrive at the air-fuel ratio correction coefficient. It is also possible to use either one or two of the three control methods (for example, PI control or the like) to obtain operation values, and the air-fuel ratio correction coefficient is calculated based on the operation values.

As can be understood from the foregoing descriptions, the engine fuel control device and the control method for requested idle air quantity according to the preferred embodiment of the present invention can stabilize the venturi chamber pressure of the venturi type fuel supply device after the engine has been started, which allows fluctuations in the engine speed after the engine has been started arising from fluctuations in the air-fuel ratio to be controlled. In addition, since a parameter relating to the engine coolant temperature is included in control constants, the device and the method can ensure stabilized starting of the engine with varying temperature conditions, even including a cold engine and an engine with room temperature.

While the invention has been described in its preferred embodiments, it is to be understood that the words which have been used are words of description rather than limitation and that changes within the purview of the appended claims may be made without departing from the true scope and spirit of the invention in its broader aspects.

What is claimed is:

1. An engine fuel control device, comprising:

a fuel supply means that supplies an engine with a fuel;

a mixture ratio determination means that determines a mixing ratio of the fuel and air;

a mixture introduction means that introduces the air-fuel mixture, whose mixing ratio has been established, into the engine;

a flow rate determination means that determines a flow rate of the mixture of the fuel and air to be drawn in by the engine;

a first throttle valve that is disposed in an intake pipe of the engine;

a bypass passage that bypasses the first throttle valve;

a second throttle valve that is disposed in the bypass passage;

a starting phase determination means that determines whether the engine is in a pre-start phase or a post-start phase;

a first opening setting means that sets the opening of the second throttle valve before starting;

a second opening setting means that sets the opening of the second throttle valve after starting; and a target opening setting means that sets at least one target opening for the second throttle valve opening when the engine shifts from the pre-start phase to the post-start phase.

2. The engine fuel control device according to claim 1, wherein the mixture ratio determination means is provided with a means that supplies the fuel supply means with fuel and a means that supplies the fuel supply means with air and determines a supply ratio of these two supply means.

3. The engine fuel control device according to claim 2, wherein the mixture ratio determination means sets the supply ratio in the pre-start phase of the engine and that in the post-start phase of the engine.

4. The engine fuel control device according to claim 3, wherein the supply ratio in the pre-start phase of the engine is determined based on factors that include one determined by an engine coolant temperature and one determined by an engine speed increase and the coolant temperature during starting.

5. The engine fuel control device according to claim 1, wherein the mixture ratio determination means selects the supply ratio according to the condition of loads of engine auxiliaries.

6. The engine fuel control device according to claim 1, wherein the mixture ratio determination means selects the supply ratio according to whether the engine is in an idle state or a non-idle state.

7. The engine fuel control device according to claim 1, wherein the starting phase determination means determines that the engine is being started based on a fact that the engine speed exceeds a predetermined value.

8. The engine fuel control device according to claim 1, wherein the starting phase determination means uses as a criterion value for determining that the engine is being started the coolant temperature when the engine is being started.

9. The engine fuel control device according to claim 1, wherein the starting phase determination means selects the criterion value for determining that the engine is being started according to the condition of loads of engine auxiliaries.

10. A control method for requested idle air quantity used in an engine fuel control device, the control device including a first throttle valve disposed in an intake pipe of an engine, a bypass passage bypassing the first throttle valve, and a second throttle valve disposed in the bypass passage, wherein a second throttle valve opening is controlled so as to maintain a target engine speed as set as the target engine speed during idling, comprising the steps of:

determining a pre-start phase and a post-start phase of the engine;

setting the second throttle valve opening for the pre-start phase;

setting at least one target opening for the second throttle valve opening when the engine shifts from the pre-start phase to the post-start phase; and setting the second throttle valve opening for the post-start phase.

* * * * *